US012780473B2

(12) United States Patent
Kubishta

(10) Patent No.: US 12,780,473 B2
(45) **Date of Patent: *Nov. 3, 2026**

(54) AUTOMATED BAG CLOSURE

(71) Applicant: KWIK LOK CORPORATION, Yakima, WA (US)

(72) Inventor: Keith Kubishta, Yakima, WA (US)

(73) Assignee: Kwik Lok Corporation, Yakima, WA (US)

( * ) Notice: Subject to any disclaimer, the term of this patent is extended or adjusted under 35 U.S.C. 154(b) by 84 days.

This patent is subject to a terminal disclaimer.

(21) Appl. No.: 18/934,733

(22) Filed: Nov. 1, 2024

(65) Prior Publication Data

US 2025/0058919 A1 Feb. 20, 2025

Related U.S. Application Data

(63) Continuation of application No. 18/008,123, filed as application No. PCT/US2020/035955 on Jun. 3, 2020, now Pat. No. 12,162,640.

(51) Int. Cl.
*B65B 51/04* (2006.01)

(52) U.S. Cl.
CPC ..... *B65B 51/043* (2013.01)

(58) Field of Classification Search
CPC ..... B65B 51/043
See application file for complete search history.

(56) References Cited

U.S. PATENT DOCUMENTS 3,061,983 A 11/1962 Irwin
3,163,969 A 1/1965 Irwin et al.
3,163,972 A * 1/1965 Irwin ..... B65B 51/043 53/138.3
3,190,053 A 6/1965 Tobey
3,270,481 A 9/1966 Rocholl
3,370,396 A 2/1968 Paxton et al.
3,412,895 A 11/1968 Hilton
3,668,818 A 6/1972 Holmes
3,910,811 A 10/1975 Paxton et al.
4,077,187 A * 3/1978 Paxton ..... B41F 19/068 53/131.5
4,171,602 A 10/1979 Richardson
4,398,379 A * 8/1983 Burford ..... B65B 51/043 53/76

(Continued)

FOREIGN PATENT DOCUMENTS

EP 0936147 A1 8/1999
WO 2021247018 A1 12/2021

*Primary Examiner* — Andrew M Tecco

(74) *Attorney, Agent, or Firm* — Seed Intellectual Property Law Group LLP

(57) ABSTRACT

An automated bag closure machine includes a mechanical bag closure advancement assembly and a mechanical bag closure breakoff assembly, wherein operation and timing of the mechanical bag closure breakoff assembly is governed by a cam and/or a manual pull-knob. The machine may include optical sensors configured to monitor the passage of bags through the machine and a fiber optic system to monitor the passage of bag closures through the machine. The machine may be mounted to other systems in a manner that allows fully fluid movement or adjustment of its position and orientation. The machine may have remote communications functionality.

6 Claims, 24 Drawing Sheets

(56) References Cited

U.S. PATENT DOCUMENTS

| | | | | | |
|---|---|---|---|---|---|
| 4,999,969 | A | | 3/1991 | Holmes | |
| 5,005,335 | A | * | 4/1991 | Yourgalite | B65B 11/045 53/399 |
| 5,269,120 | A | * | 12/1993 | Holmes | B65B 51/043 53/64 |
| 5,600,938 | A | * | 2/1997 | Trimble | B65B 51/00 53/138.4 |
| 5,746,043 | A | * | 5/1998 | Terminella | B29C 66/8222 53/551 |
| 5,755,074 | A | * | 5/1998 | Fetters | B65B 59/04 198/395 |
| 6,098,370 | A | * | 8/2000 | Kobayashi | B65B 51/043 53/138.3 |
| 7,093,410 | B2 | * | 8/2006 | van Drunen | B65D 33/1625 24/30.5 S |
| 9,714,106 | B2 | * | 7/2017 | May | B65B 63/026 |
| 10,807,744 | B1 | * | 10/2020 | Seiver | B67B 7/42 |
| 12,162,640 | B2 | * | 12/2024 | Kubishta | B65B 51/043 |
| 2005/0284102 | A1 | * | 12/2005 | Herzog | B29C 66/91431 53/329.2 |
| 2006/0101787 | A1 | * | 5/2006 | Hartmann | B65B 51/043 53/138.3 |
| 2010/0287883 | A1 | * | 11/2010 | May | B65B 39/02 53/436 |

* cited by examiner

AUTOMATED BAG CLOSURE

BACKGROUND

Technical Field

The present disclosure relates generally to improved methods and systems for automated closure of bags, such as bags holding food items.

Description of the Related Art

Many food items, such as sliced bread, potatoes, apples, oranges, ice, etc., are packaged for purchase by end consumers, such as in grocery stores, in closed bags. Such bags are often held closed by easily removable bag closures, such as those commercially available from Kwik Lok Corporation of Yakima, Washington. For many years, Kwik Lok Corporation has also developed automated bag closing machines that apply such bag closures to bags filled with food items, such as while the bags travel along a conveyor belt.

BRIEF SUMMARY

A system for applying bag closures from an elongate strip of connected bag closures to bags may be summarized as comprising: a breakoff lever configured to break a single bag closure off an end of the elongate strip of connected bag closures during movement of the breakoff lever; a motor; a cam; and a clutch configured to engage the cam to the motor and to disengage the cam from the motor; wherein the cam is mechanically coupled to the breakoff lever such that rotation of the cam controls the movement of the breakoff lever.

The movement of the breakoff lever may be rotational movement of the breakoff lever. The system may further comprise a driven shaft, wherein the cam is coupled to the driven shaft and the clutch is configured to engage the driven shaft to the motor to engage the cam to the motor and to disengage the driven shaft from the motor to disengage the cam from the motor. When the cam is not rotating, the cam may be at a neutral position and a heel of the cam may be mechanically engaged with the breakoff lever.

The cam may have a profile shaped such that, when the cam rotates, the heel of the cam mechanically engages the breakoff lever from the neutral position to between 25 degrees and 35 degrees of rotation of the cam from the neutral position. The cam may have a profile shaped such that, when the cam rotates, a linear opening ramp of the cam mechanically engages the breakoff lever from between 25 degrees and 35 degrees of rotation of the cam from the neutral position to between 55 degrees and 65 degrees of rotation of the cam from the neutral position. The cam may have a profile shaped such that, when the cam rotates, a transitional opening flank of the cam mechanically engages the breakoff lever from between 55 degrees and 65 degrees of rotation of the cam from the neutral position to between 85 degrees and 95 degrees of rotation of the cam from the neutral position. The cam may have a profile shaped such that, when the cam rotates, a nose of the cam mechanically engages the breakoff lever from between 85 degrees and 95 degrees of rotation of the cam from the neutral position to between 185 degrees and 195 degrees of rotation of the cam from the neutral position. The cam may have a profile shaped such that, when the cam rotates, a transitional closing flank of the cam mechanically engages the breakoff lever from between 185 degrees and 195 degrees of rotation of the cam from the neutral position to between 215 degrees and 225 degrees of rotation of the cam from the neutral position. The cam may have a profile shaped such that, when the cam rotates, a linear closing ramp of the cam mechanically engages the breakoff lever from between 215 degrees and 225 degrees of rotation of the cam from the neutral position to between 245 degrees and 255 degrees of rotation of the cam from the neutral position. The cam may have a profile shaped such that, when the cam rotates, the heel of the cam mechanically engages the breakoff lever from between 245 degrees and 255 degrees of rotation of the cam from the neutral position to 360 degrees of rotation of the cam from the neutral position. The system may be configured to advance the elongate strip of connected bag closures when the cam has rotated between 245 degrees and 255 degrees from the neutral position.

A system for applying bag closures from an elongate strip of connected bag closures to bags may be summarized as comprising: a mechanical bag closure breakoff assembly including a breakoff lever configured to break a single bag closure off an end of the elongate strip of connected bag closures during movement of the breakoff lever; a mechanical bag closure advancement assembly; an outer housing that encloses mechanical components of the mechanical bag closure breakoff assembly and mechanical components of the mechanical bag closure advancement assembly; a knob located outside of the outer housing and on an exterior of the system, wherein the knob is mechanically coupled to the breakoff lever such that motion of the knob controls the movement of the breakoff lever.

The housing may include a sleeve and the knob may be coupled to a rod that extends through the sleeve. The sleeve may have a first flange, the rod may have a second flange, and a spring may be mounted on the rod between the first flange and the second flange. The knob may be rotatably coupled to a mechanical linkage, the mechanical linkage may have a slot that extends along a length of the mechanical linkage, and the knob may be mechanically coupled to the breakoff lever by a pin that extends through the slot.

A system for applying bag closures from an elongate strip of connected bag closures to bags as the bags travel along a path with respect to the system may be summarized as comprising: an optical sensor located at a first side of the path; and an optical reflector located at a second side of the path opposite to the first side of the path; wherein the optical sensor and the optical reflector face one another such that light emitted by the optical sensor is reflected by the optical reflector toward the optical sensor.

The optical sensor may be configured to emit and detect infrared light. The system may include an inner set of rotating wheels and an outer set of rotating wheels and the optical sensor and the optical detector may be located between the inner set of rotating wheels and the outer set of rotating wheels.

A system for applying bag closures from an elongate strip of connected bag closures to bags as the bags travel along a path with respect to the system may be summarized as comprising: a guide plate including a slot and an opening, wherein the slot is configured to receive the elongate strip of connected bag closures and the opening extends through the guide plate and is open to the slot; and a fiber optic cable, wherein a terminal distal end of the fiber optical cable faces toward and through the opening and faces toward and through the slot. The opening may be open to an upstream portion of the slot with respect to the path the bags travel with respect to the system.

A system for applying bag closures from an elongate strip of connected bag closures to bags as the bags travel along a path with respect to the system may be summarized as comprising: an outer housing including an outer wall; and a mounting assembly coupled to the outer wall, the mounting assembly configured to mount the system to a conveyor configured to carry bags along the path with respect to the system; wherein the mounting assembly includes a knob coupled to a threaded rod; wherein when the knob and the threaded rod are turned in a first direction, the knob and the threaded rod move toward the outer wall and can move toward the outer wall until a terminal distal end of the threaded rod engages the outer wall such that the knob and the threaded rod are restrained against translation with respect to the outer wall; wherein when the knob and the threaded rod are turned in a second direction opposite to the first direction, the knob and the threaded rod move away from the outer wall and can move away from the outer wall until a terminal distal end of the threaded rod does not engage the outer wall such that the knob and the threaded rod are not restrained against translation with respect to the outer wall.

The outer wall may be a trailing outer wall of the outer housing. When the knob is turned the threaded rod may thread through a plate to actuate movement of the knob and the threaded rod with respect to the outer wall.

A system for applying bag closures from an elongate strip of connected bag closures to bags as the bags are carried along a path with respect to the system by a conveyor may be summarized as including the system communicatively coupled to the conveyor by a communications network and configured to shut down upon receipt of a signal received from the conveyor via the communications network indicating that the conveyor has shut down.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Figure 1:
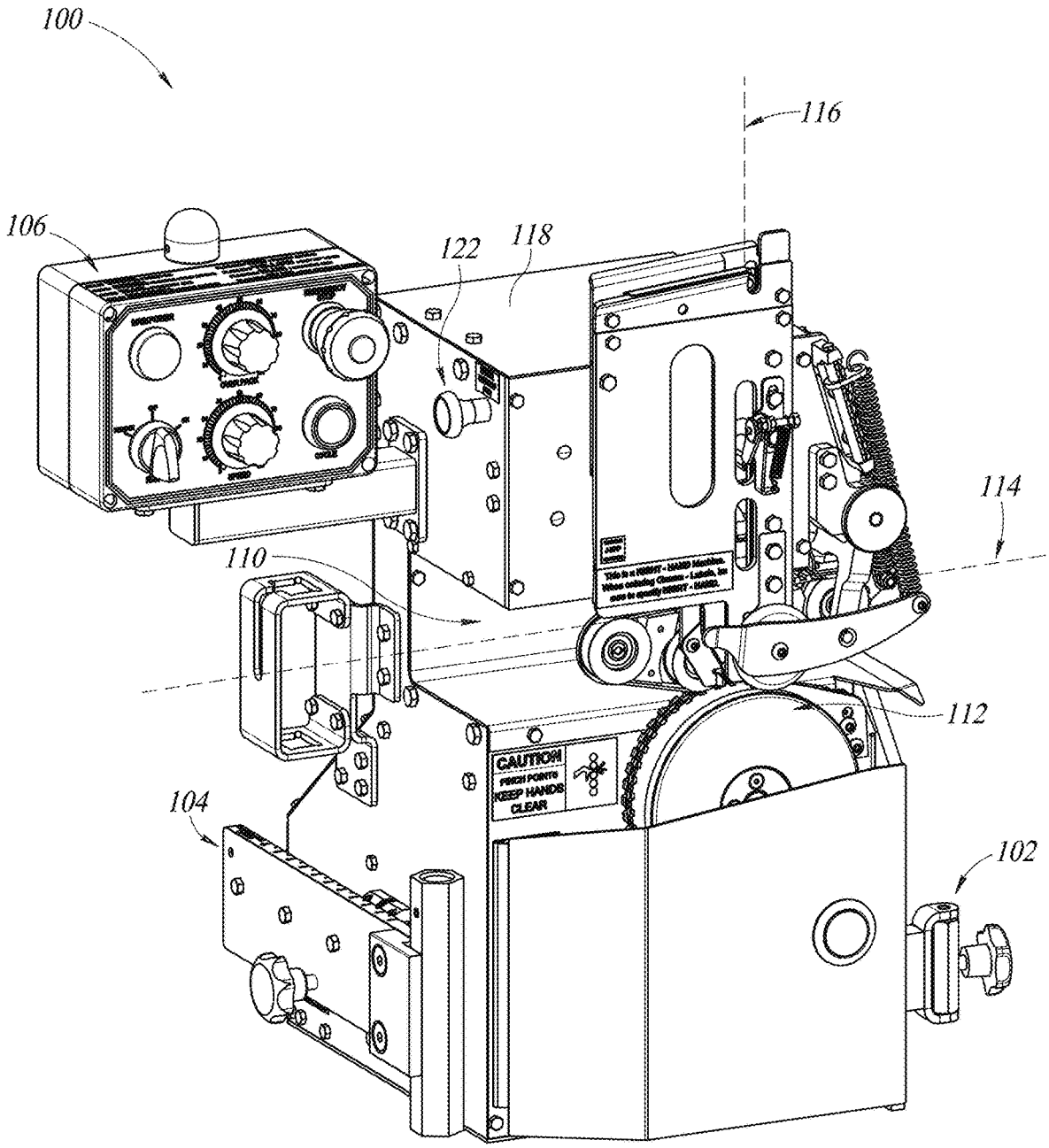
FIG. 1 illustrates a front, top, and left side perspective view of a bag closure machine.
Figure 2:
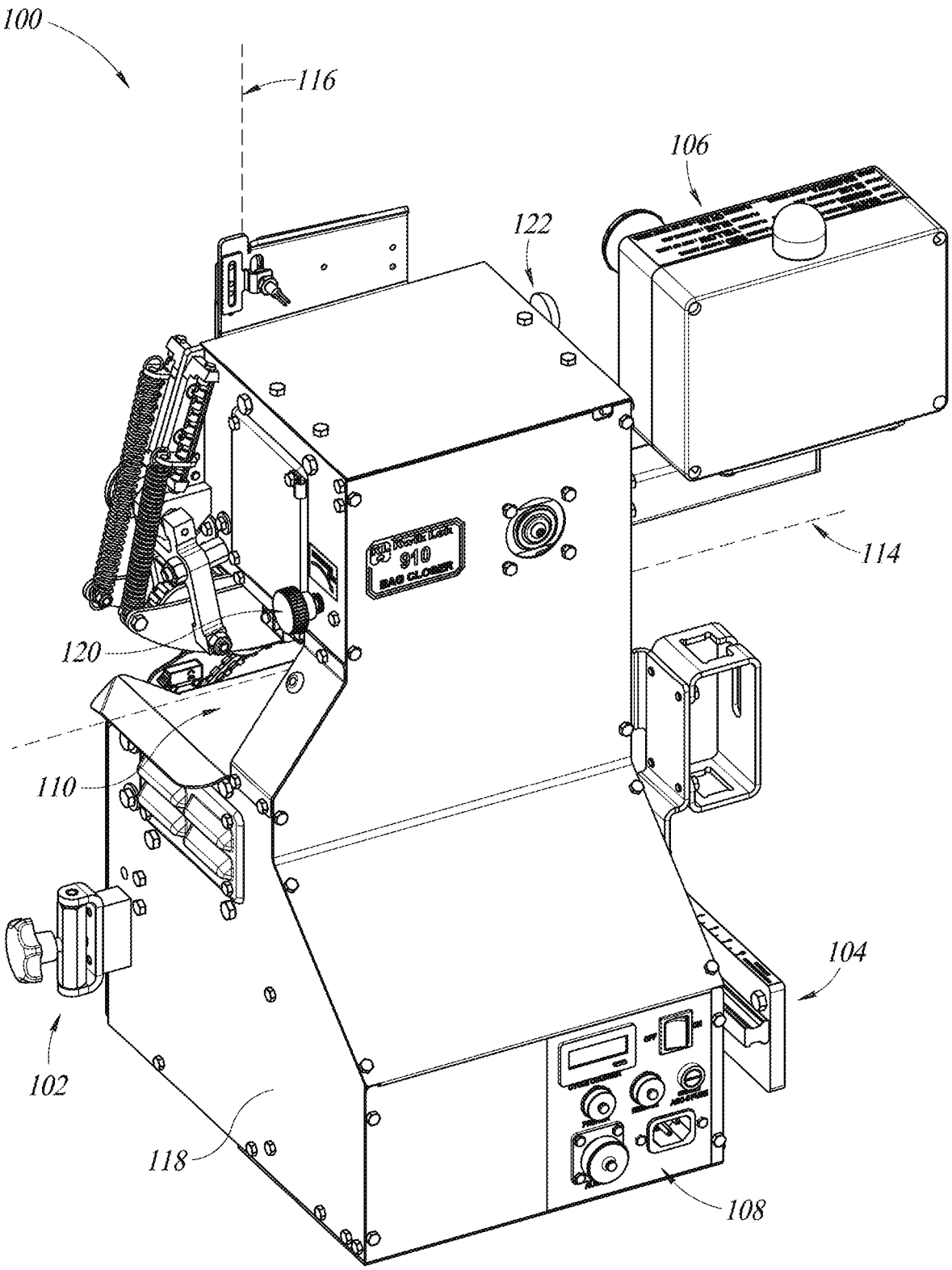
FIG. 2 illustrates a rear, top, and right side perspective view of the bag closure machine of FIG. 1.

FIG. 1 illustrates a front, top, and left side perspective view, and FIG. 2 illustrates a rear, top, and right side perspective view, of a bag closure machine 100. As illustrated in FIGS. 1 and 2, the bag closure machine 100 includes a mounting system for mounting the machine 100 to other systems within a production and/or packaging facility, such as to a conveyor or conveyor belt therein, the conveyor or conveyor belt carrying bags or other packages to be closed by the bag closure machine 100. As illustrated in FIGS. 1 and 2, the mounting system includes a first portion 102 thereof coupled to a right side surface of a right side wall of a bottom portion of a housing 118 of the machine 100 and a second portion 104 thereof coupled to a left side surface of a left side wall of the bottom portion of the housing 118 of the machine 100. As also illustrated in FIGS. 1 and 2, the bag closure machine 100 further includes a human-machine interface 106, which faces toward a front of the machine 100, and through which a human operator can interact with the machine 100 during normal operation thereof. As illustrated in FIG. 2, the bag closure machine 100 also includes an electrical interface 108, which faces toward a rear of the machine 100, and through which various electrical components can be coupled to the machine 100. As examples, the electrical interface 108 includes a plurality of ports configured to receive electric or electronic cords or cables (e.g., power cords and/or communications cables) to provide power and/or communications capabilities to the machine 100 and the components thereof, and a mechanical rocker switch, such as to power the machine 100 on and/or off.

As used herein, terms such as "front," "forward," "back," "rearward," "behind," "left," "right," and other similar terminology, when used in the context of the bag closure machine 100 and other components described herein, are used in their ordinary sense with respect to the perspective of the conveyor or conveyor belt carrying bags or other packages to be closed with respect to the machine 100, as well as with respect to the bags and items held therein being carried by the conveyor. In this sense, the "front" of the machine 100 may also be referred to as a "package interface side" of the machine 100. The present application describes various components as being on the "right" or the "left" of other components, and the use of such terms is internally consistent herein. In alternative embodiments, however, the features of a bag closure machine may be arranged in a mirror image configuration with respect to that described herein. As used herein, terms of relative elevation, such as "top," "bottom," "upper," lower," "above," "below," "up," and "down," when used in the context of the bag closure machine 100 and other components described herein, are used in their ordinary sense, that is, with respect to a direction of a gravitational force, such that gravity pulls objects down. Additionally, "inner" and "outer," and other similar terminology, are used herein with respect to a center of the bag closure machine 100.

As further illustrated in FIGS. 1 and 2, the bag closure machine 100 has an open space, conduit, passage, or channel 110 behind a set of rotating wheels 112 and extending left-to-right through the machine 100 along a horizontal central longitudinal axis 114 thereof. When the machine 100 is in use and applying bag closures to bags pre-filled with food items, the bags can travel right-to-left with respect to the machine 100 (thus, the terms "right" and "left," as used herein, may also mean "upstream" and "downstream," respectively, or "leading" and "trailing," respectively), such that an open end of the bag travels through the open channel 110 along the axis 114, and such that a neck portion of the bag, which is located between an open end of the bag and the portion of the bag filled with the food items, and to which the bag closure is to be applied, travels between and is pinched closed by the set of rotating wheels 112 and/or timing belt(s) coupled to the set of rotating wheels 112. The bag closure machine 100 is also configured to collect or bunch up the neck portion of the bag at a location proximate the set of rotating wheels 112, such that the neck portion of the bag is prepared to receive and be closed by a bag closure. In some embodiments, while the machine 100 has power and/or is switched on, the motor 124 constantly powers the set of rotating wheels 112, such that the set of rotating wheels 112 is supplied with power constantly, and such that each of the wheels in the set of rotating wheels 112 rotates, throughout operation of the machine 100 as described herein, regardless of the actions of any other components of the machine 100.

As also illustrated in FIGS. 1 and 2, the bag closure machine 100 has an open space, conduit, passage, or channel extending up-and-down through the machine 100 along a vertical central longitudinal axis 116 thereof. When the machine 100 is in use and applying bag closures to bags pre-filled with food items, an elongate strip of connected bag closures can travel top-to-bottom or downward with respect to the machine 100 along the axis 116. The vertical central longitudinal axis 116 intersects a path of the neck portions of the bags as the bags travel right-to-left with respect to the machine 100. The machine 100 is configured to recognize when the neck portion of a bag is completely bunched up at a location along the axis 116, to use a mechanical bag closure advancement assembly to advance the elongate strip of connected bag closures until a bottom-most one of the bag closures is positioned to receive the bunched-up neck of the bag, thereby closing the bag, and, once the bag is closed by the bag closure, to use a mechanical bag closure breakoff assembly to break the bottom-most one of the bag closures off of the elongate strip of connected bag closures, so that the closed bag can be carried away from the machine 100 for further operations, such as additional packaging.

FIGS. 1 and 2 illustrate that the machine 100 includes an outer enclosure or enclosed housing 118 that encloses and protects many other internal components thereof, and to which external components thereof (e.g., the first and second portions 102, 104 of the mounting system and the human-machine and electrical interfaces 106, 108) are coupled or mounted. FIGS. 1 and 2 further illustrate that the housing 118 includes a bottom portion thereof below or substantially below the channel 110, and a top portion thereof above or substantially above the channel 110. FIG. 2 illustrates that the machine 100 includes a first knob 120 protruding from a right side wall of the top portion of the housing 118. In some embodiments, the first knob 120 can be rotated by a human operator, such as in a clockwise direction, to disengage the mechanical bag closure advancement assembly from the elongate strip of connected bag closures. FIG. 1 illustrates that the machine 100 includes a second knob 122 protruding from a left side wall of the top portion of the housing 118. In some embodiments, the second knob 122 can be pulled outward from the housing 118 by a human operator, such as in a leftward direction, to manually break the bottom-most one of the bag closures off of the elongate strip of connected bag closures.

Figure 3:
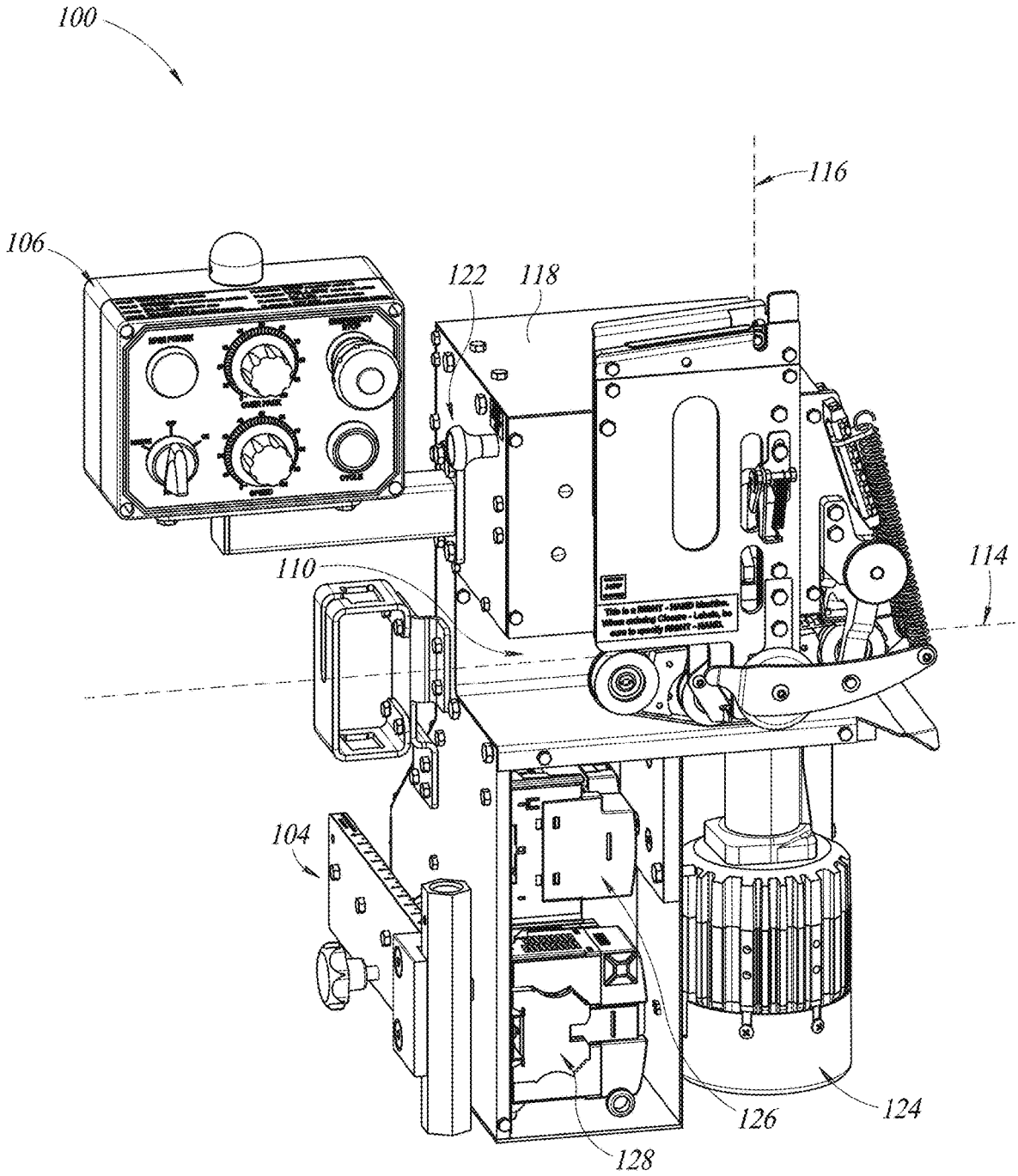
FIG. 3 illustrates a front, top, and left side perspective view of the bag closure machine of FIGS. 1 and 2 with portions of a housing thereof removed to show additional internal components.
Figure 4:
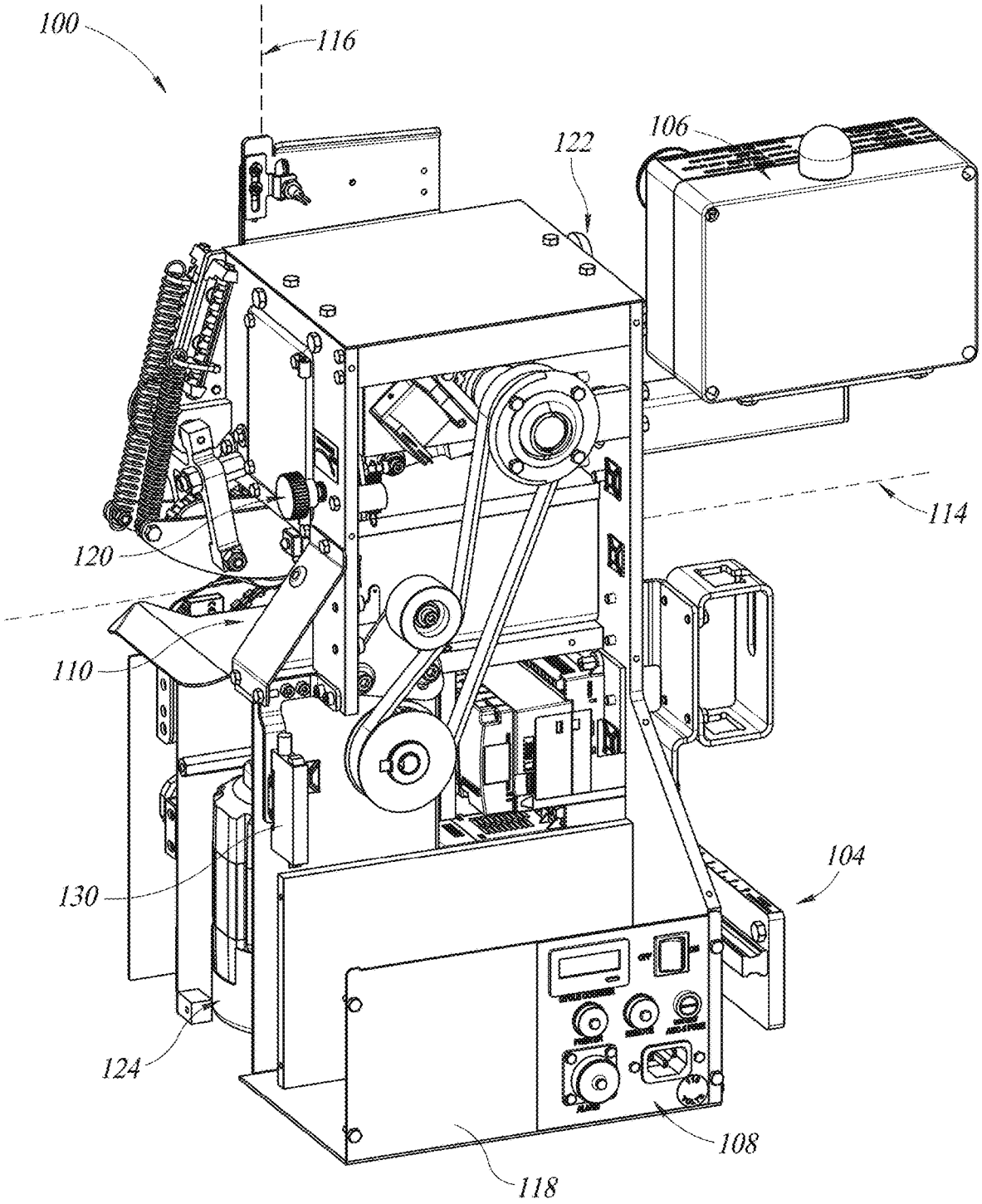
FIG. 4 illustrates a rear, top, and right side perspective view of the bag closure machine of FIGS. 1 and 2 with portions of a housing thereof removed to show additional internal components.
Figure 5:
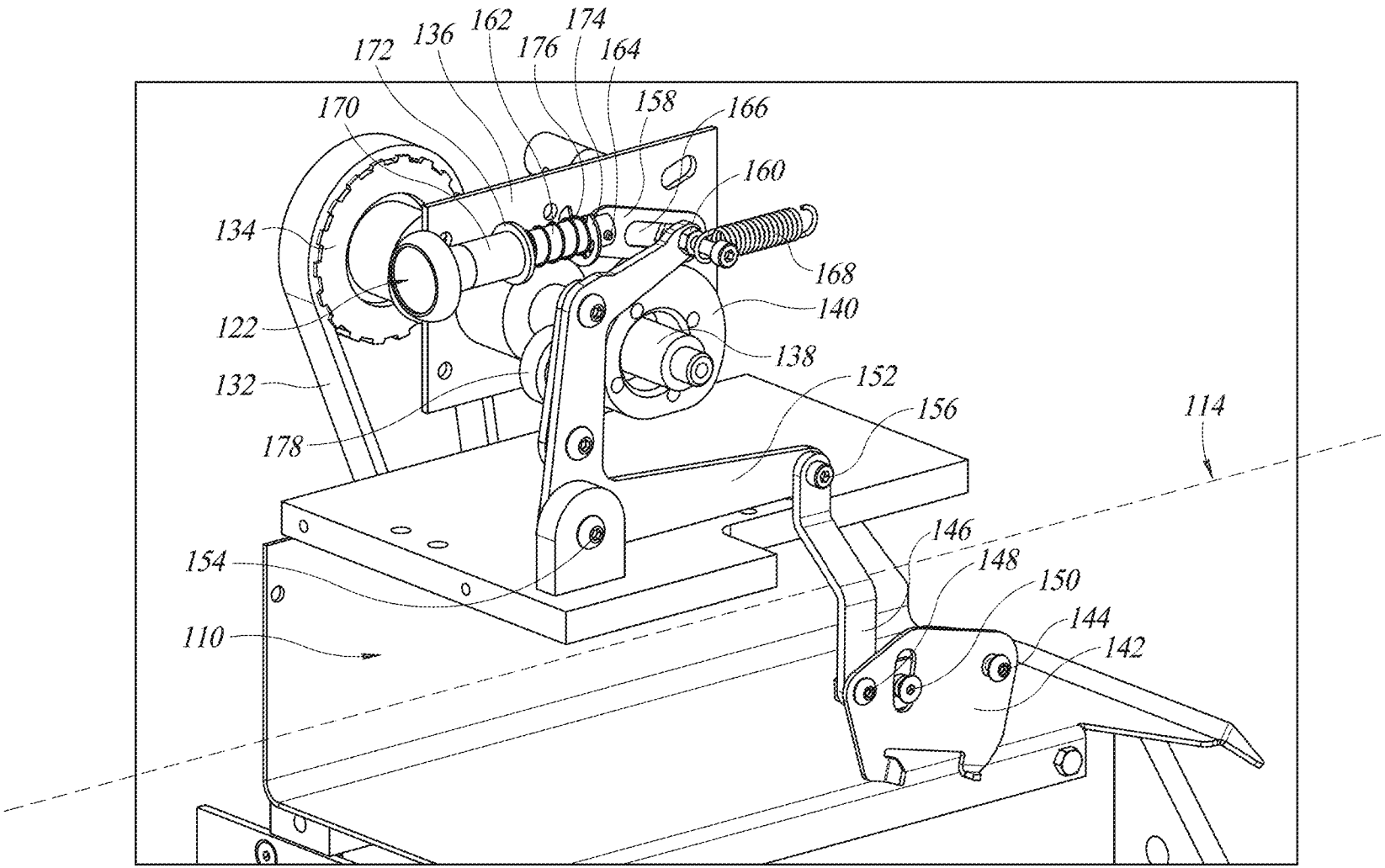
FIG. 5 illustrates a front, top, and left side perspective view of the bag closure machine of FIGS. 1 and 2 with some components removed to show additional internal components governing operation and timing of a mechanical bag closure breakoff assembly.
Figure 6:
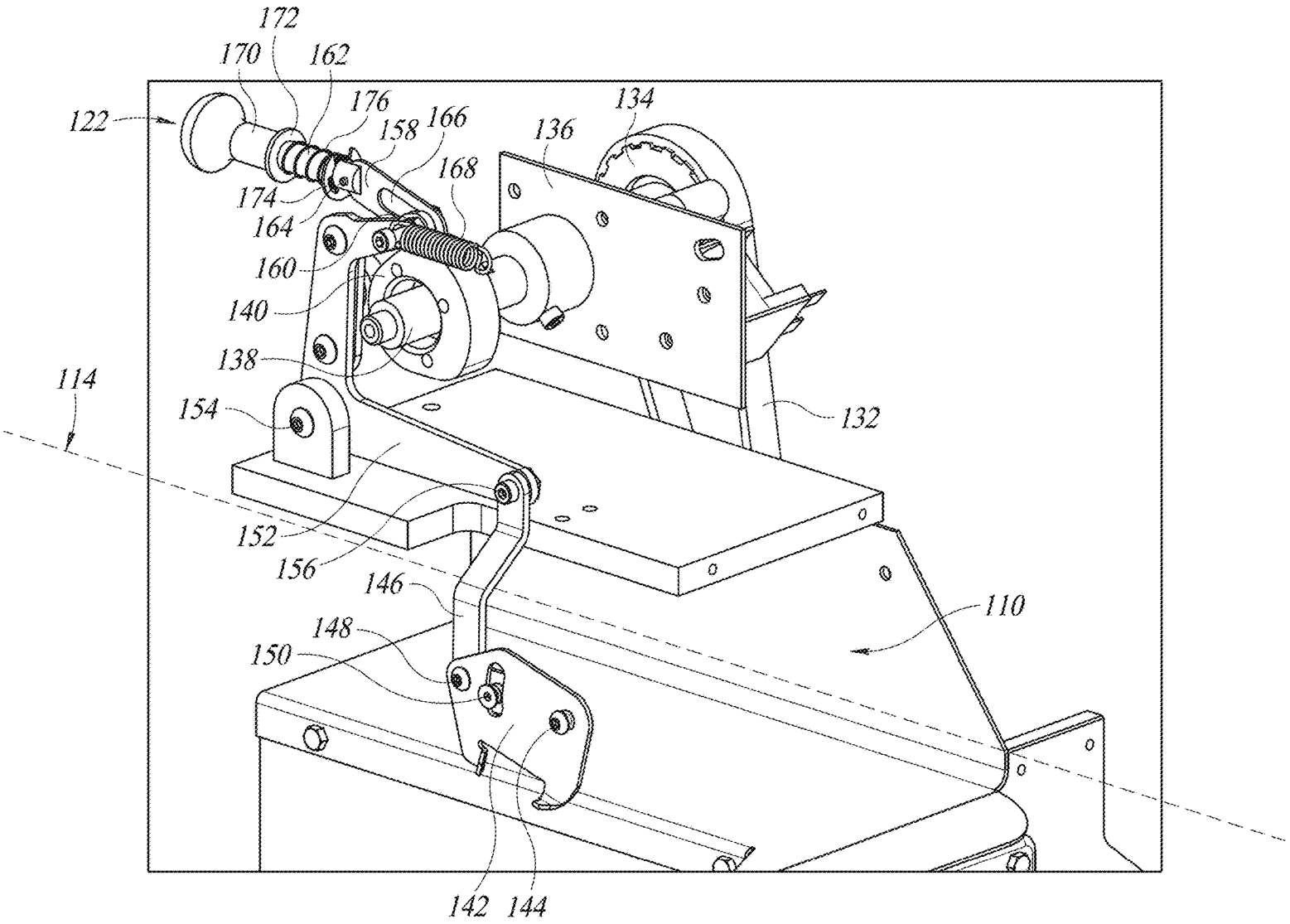
FIG. 6 illustrates a front, top, and right side perspective view of the bag closure machine of FIGS. 1 and 2 with some components removed to show additional internal components governing operation and timing of the mechanical bag closure breakoff assembly.

FIG. 3 illustrates a front, top, and left side perspective view of the bag closure machine 100 with front and right side walls of the bottom portion of the housing 118 removed to show internal components thereof. For example, as illustrated in FIG. 3, the machine 100 includes a motor 124, which may be a 230 Volt AC, ⅙ horsepower electric motor. As additional examples, the machine 100 includes a programmable logic controller ("PLC") 126, which may be a commercially available PLC such as that available from Rockwell Automation, Inc., under the name Micro 820, as well as a power supply 128, which may be a commercially available 24 Volt DC power supply, and which may be configured to receive power via a port in the electrical interface 108 and condition the power, e.g., convert the power to a different voltage, current, and/or frequency, for use by other components of the device 100, such as the PLC 126. FIG. 4 illustrates a rear, top, and right side perspective view of the bag closure machine 100 with rear and right side walls of the bottom portion of the housing 118 removed to show internal components thereof. In particular, as illustrated in FIG. 4, the machine 100 includes a fiber optic amplifier and/or sensor 130, which may be a commercially available fiber optic amplifier and/or sensor such as that available under the name and model number Allen Bradley 45FSL2LHE-P4.

The mechanical bag closure breakoff assembly and the mechanical bag closure advancement assembly may both be located inside of and housed within the top portion of the housing 118 above the channel 110. FIGS. 5-11 illustrate different views of the bag closure machine 100 with components thereof, including the top portion of the housing 118 and other components housed therein, including of the mechanical bag closure advancement assembly, removed, to illustrate components of the mechanical bag closure breakoff assembly in greater detail. As illustrated in FIGS. 5-11, the mechanical bag closure breakoff assembly includes a mechanical breakoff lever 142, which is rotatably or pivotally coupled to the rest of the machine 100 by a screw, bolt, or pin at a pivot point 144, about which the breakoff lever 142 can rotate to break the bottom-most one of the bag closures off of the elongate strip of connected bag closures. For example, the breakoff lever 142 can be rotated clockwise about the pivot point to break the bottom-most one of the bag closures from the elongate strip of connected bag closures, and can then be rotated counter-clockwise until it returns to its original, resting, neutral, or baseline position. The extent of such rotation may be limited, such as by a travel limiter 150. The breakoff lever 142 can alternately rotate clockwise and counter-clockwise in this manner, or oscillate, to break off a series of the bag closures as the bag closures are applied to a series of bags by the machine 100.

As also illustrated in FIGS. 5-11, the mechanical bag closure breakoff assembly includes a first mechanical linkage 146, which is rotatably or pivotally coupled at a first, bottom end portion thereof to the breakoff lever 142 by a screw, bolt, or pin at a pivot point 148. The first linkage 146 can rotate about the pivot point 148 with respect to the breakoff lever 142 and transmit forces to the breakoff lever 142 at the pivot point 148. Thus, the first linkage 146 can be moved upwards to cause the breakoff lever 142 to rotate clockwise, such as to break off a bag closure, and can be moved downwards to cause the breakoff lever 142 to rotate counter-clockwise, such as to return the breakoff lever 142 to its original, resting, neutral, or baseline position.

As also illustrated in FIGS. 5-11, the mechanical bag closure breakoff assembly includes a driving lever 152, which has a generally L-shaped or C-shaped profile when viewed from the front, such that it includes a first, generally horizontal arm that extends generally from left-to-right, and a second, generally vertical arm that extends generally up-and-down, where a bottom end of the vertical arm is coupled to a left end of the horizontal arm. In some embodiments, as illustrated in FIGS. 5-11, the vertical arm of the driving lever 152 extends over most of its length, and over a portion thereof proximate the horizontal arm, directly upward or vertically, and over a smaller portion of its length, and over a portion thereof distal from the horizontal arm, at an angle both upwardly or vertically and rightward or horizontally, such that the distal portion of the vertical arm partially overlies a portion of the horizontal arm proximate the vertical arm.

The driving lever 152 is rotatably or pivotally coupled at the corner thereof where the bottom end of the vertical arm is coupled to the left end of the horizontal arm to the rest of the machine 100 by a screw, bolt, or pin at a pivot point 154, about which the driving lever 152 can rotate, such as to actuate movement of the first linkage 146 and the breakoff lever 142. The driving lever 152 is rotatably or pivotally coupled at a right end of the horizontal arm thereof to a second, top end portion of the first linkage 146, opposite the first, bottom end portion thereof, by a screw, bolt, or pin at a pivot point 156. The driving lever 152 can rotate about the pivot point 156 with respect to the first linkage 146 and transmit forces to the first linkage 146 at the pivot point 156. Thus, the driving lever 152 can be rotated counter-clockwise about the pivot point 154 to move the first linkage 146 upwards to cause the breakoff lever 142 to rotate clockwise, such as to break off a bag closure, and can be rotated clockwise about the pivot point 154 to move the first linkage 146 downwards to cause the breakoff lever 142 to rotate counter-clockwise, such as to return the breakoff lever 142 to its original, resting, neutral, or baseline position.

As also illustrated in FIGS. 5-11, the mechanical bag closure breakoff assembly includes a second, generally horizontal mechanical linkage 158, which has a slot 166 extending along a length thereof and which is coupled at a first, right end portion thereof to a top end portion of the vertical arm of the driving lever 152 by a screw, bolt, or pin 160, such that the screw, bolt, or pin 160 can travel through the slot 166 along the length of the second linkage 158. When the screw, bolt, or pin 160 is at a terminal end of the slot 166, the second linkage 158 can transmit forces to the driving lever 152 via the screw, bolt, or pin 160. Thus, the linkage 158 can be moved leftwards to cause the driving lever 152 to rotate counter-clockwise about the pivot point 154, to move the first linkage 146 upwards, to cause the breakoff lever 142 to rotate clockwise, such as to break off a bag closure, and can be moved rightwards to allow the driving lever 152 to rotate clockwise about the pivot point 154, to move the first linkage 146 downwards, to cause the breakoff lever 142 to rotate counter-clockwise, such as to return the breakoff lever 142 to its original, resting, neutral, or baseline position.

As also illustrated in FIGS. 5-11, the mechanical bag closure breakoff assembly includes a first spring 168 that is mounted at a first, rightmost end thereof to a stationary, rigid component of the machine 100, such as to the housing 118 or to a component rigidly coupled to the housing 118. A second, leftmost end of the spring 168 opposite to the first, rightmost end thereof is coupled to the screw, bolt, or pin 160, and the spring 168 is generally in tension, such that the spring 168 biases the screw, bolt, or pin 160 rightward and biases the driving lever 152 to rotate clockwise. Thus, when the linkage 158 is moved rightwards to allow the driving lever 152 to rotate clockwise about the pivot point 154, the spring 168 causes the driving lever 152 to rotate clockwise about the pivot point 154, to move the first linkage 146 downwards, and to cause the breakoff lever 142 to rotate counter-clockwise, such as to return the breakoff lever 142 to its original, resting, neutral, or baseline position.

As also illustrated in FIGS. 5-11, the mechanical bag closure breakoff assembly includes the second knob 122 and a cylindrical rod 162 rigidly coupled at a first, left end portion thereof to the second knob 122, where the cylindrical rod 162 is rotatably or pivotally coupled at a second, right end portion thereof opposite the first, left end portion thereof to a second, left end portion of the second linkage 158 opposite to the first, right end portion thereof, by a screw, bolt, or pin at a pivot point 164. The rod 162 can rotate about the pivot point 164 with respect to the second linkage 158 and transmit forces to the second linkage 158 at the pivot point 164. Thus, the second knob 122 can be pulled, such as by a human operator, or otherwise moved leftwards or outward with respect to the housing 118, to move the cylindrical rod 162 and the second linkage 158 leftwards, to cause the driving lever 152 to rotate counter-clockwise about the pivot point 154, to move the first linkage 146 upwards, to cause the breakoff lever 142 to rotate clockwise, such as to break off a bag closure, and can be pushed, such as by a human operator, or otherwise moved rightwards or inward with respect to the housing 118, and returned to its original, resting, neutral, or baseline position, to move the cylindrical rod 162 and the second linkage 158 rightwards to allow the driving lever 152 to rotate clockwise about the pivot point 154, to move the first linkage 146 downwards, to cause the breakoff lever 142 to rotate counter-clockwise, such as to return the breakoff lever 142 to its original, resting, neutral, or baseline position.

As also illustrated in FIGS. 5-11, the mechanical bag closure breakoff assembly includes a sleeve 170 that is rigidly mounted in the left side wall of the top portion of the housing 118. The sleeve 170 has a hollow cylindrical shape, is stationary, and does not move with respect to the housing 118, but provides a wear-resistant, low-friction bearing surface for the cylindrical rod 162 to engage and bear against as it moves through the left side wall of the top portion of the housing 118. As illustrated in FIGS. 5-11, an inner, right side portion of the sleeve 170 has a peripheral flange 172 that extends radially outward from the rest of the sleeve 170. As also illustrated in FIGS. 5-11, a right end portion of the cylindrical rod 162 also includes a corresponding peripheral flange 174 that extends radially outward from the rest of the cylindrical rod 162. In some embodiments, the rod 162 itself may have a groove at the location of the flange 174, and the flange 174 may be formed of a ring of material seated within the groove.

The mechanical bag closure breakoff assembly further includes a second spring 176 that is mounted on the cylindrical rod 162 between the flange 172 and the flange 174, such that a first end of the second spring 176 engages and bears against the flange 172 and a second end of the second spring 176 opposite the first end thereof engages and bears against the flange 174. Thus, when the knob 122 and the cylindrical rod 162 are pulled outward with respect to the housing 118, or leftward, the flange 174 moves toward the flange 172 and the second spring 176 is compressed between the flange 174 and the flange 172. Thus, the second spring 176 may generally be in compression, such that the spring 176 biases the knob 122 and the cylindrical rod 162 rightward and into the housing 118. Thus, if a human operator pulls the knob 122 outward with respect to the housing 118 and then lets it go and leaves it, then the bias provided by the second spring 176 will cause the knob 122 and cylindrical rod 162 to move rightward and inward with respect to the housing 118, such that they return to their original, resting, neutral, or baseline positions.

As also illustrated in FIGS. 5-11, the machine 100 includes a belt 132 or other loop of flexible material that mechanically links an output of the motor 124 to the bag closure breakoff assembly. In particular, the belt 132 extends along a path across a rear portion of the machine 100, from inside the bottom portion of the housing 118, where the motor 124 is located, to inside the top portion of the housing 118, where the bag closure breakoff assembly is located, and where it powers, turns, or applies a torque to an input gear or wheel 134 mounted to a clutch 136 and configured to rotate under the power provided by the motor 124 and the belt 132 about a horizontal axis extending front-to-back and perpendicularly to the axis 114 of the channel 110 and to the vertical axis 116 along which the elongate strip of connected bag closures travels when the machine 100 is in use. In some embodiments, while the machine 100 has power and/or is switched on, the motor 124 constantly powers the belt 132 and the belt 132 constantly powers the gear or wheel 134, such that the gear or wheel 134 is supplied with power constantly and throughout operation of the machine 100 as described herein, regardless of the actions of any other components of the machine 100.

The clutch 136 is configured to receive commands generated and sent by the PLC, and, based on such commands, to selectively engage and disengage rotation and/or torques, and thereby to selectively transmit mechanical power, from an input to the clutch 136, specifically, from the gear or wheel 134, which may be referred to as a driving wheel 134 for the clutch 136, to an output of the clutch 136, specifically, to a driven shaft 138 of the clutch 136. The driven shaft 138 of the clutch 136 is rigidly coupled to a cam 140, which is securely mounted on the driven shaft 138 such that rotation of the driven shaft 138 drives the cam 140 to rotate the same angular distance, and in the same direction, as the driven shaft 138. The cam 140 is an input cam 140 or a driving cam 140 that governs normal operation and timing of the bag closure breakoff assembly.

Figure 7:
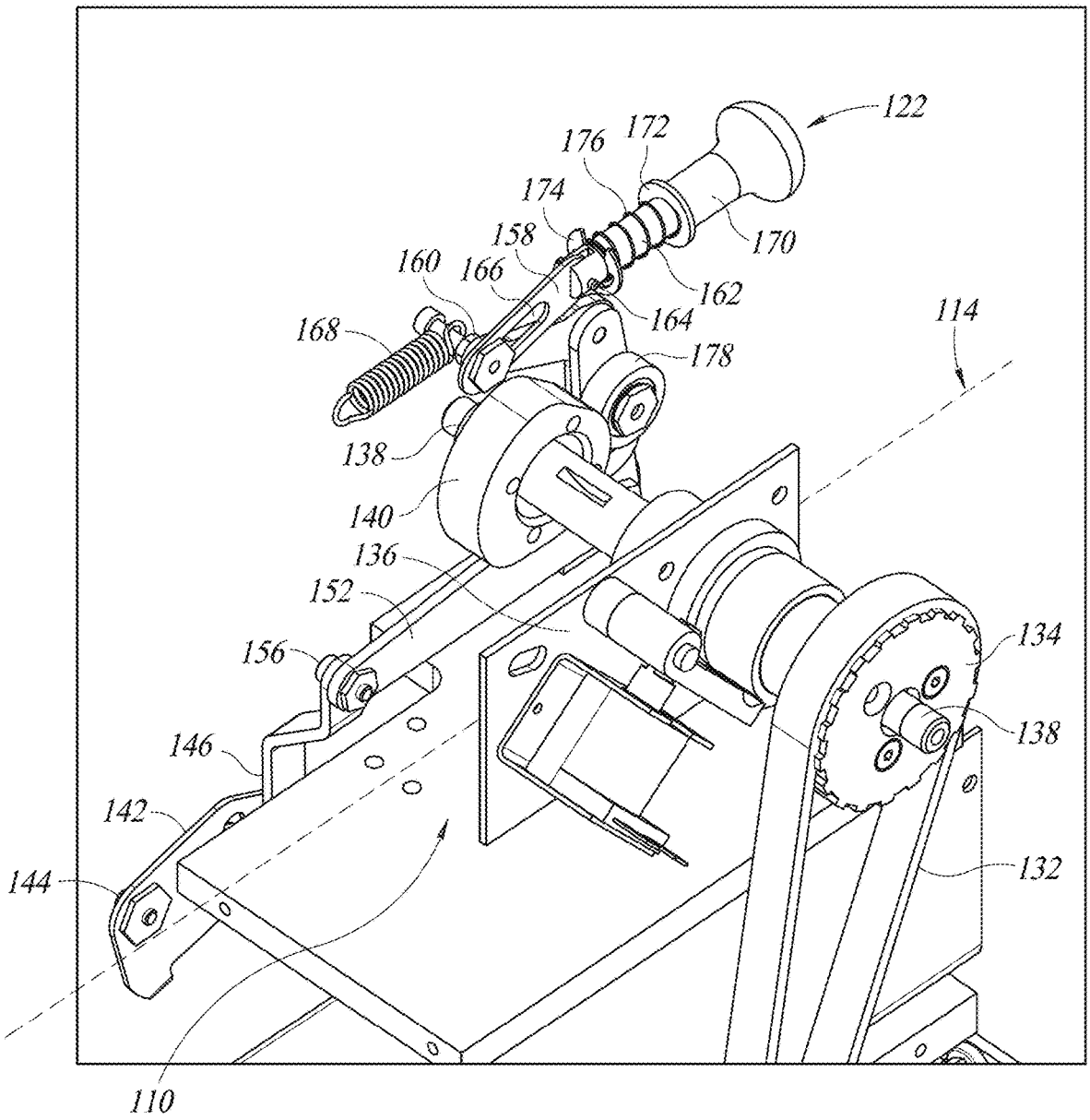
FIG. 7 illustrates a rear, top, and right side perspective view of the bag closure machine of FIGS. 1 and 2 with some components removed to show additional internal components governing operation and timing of the mechanical bag closure breakoff assembly.
Figure 8:
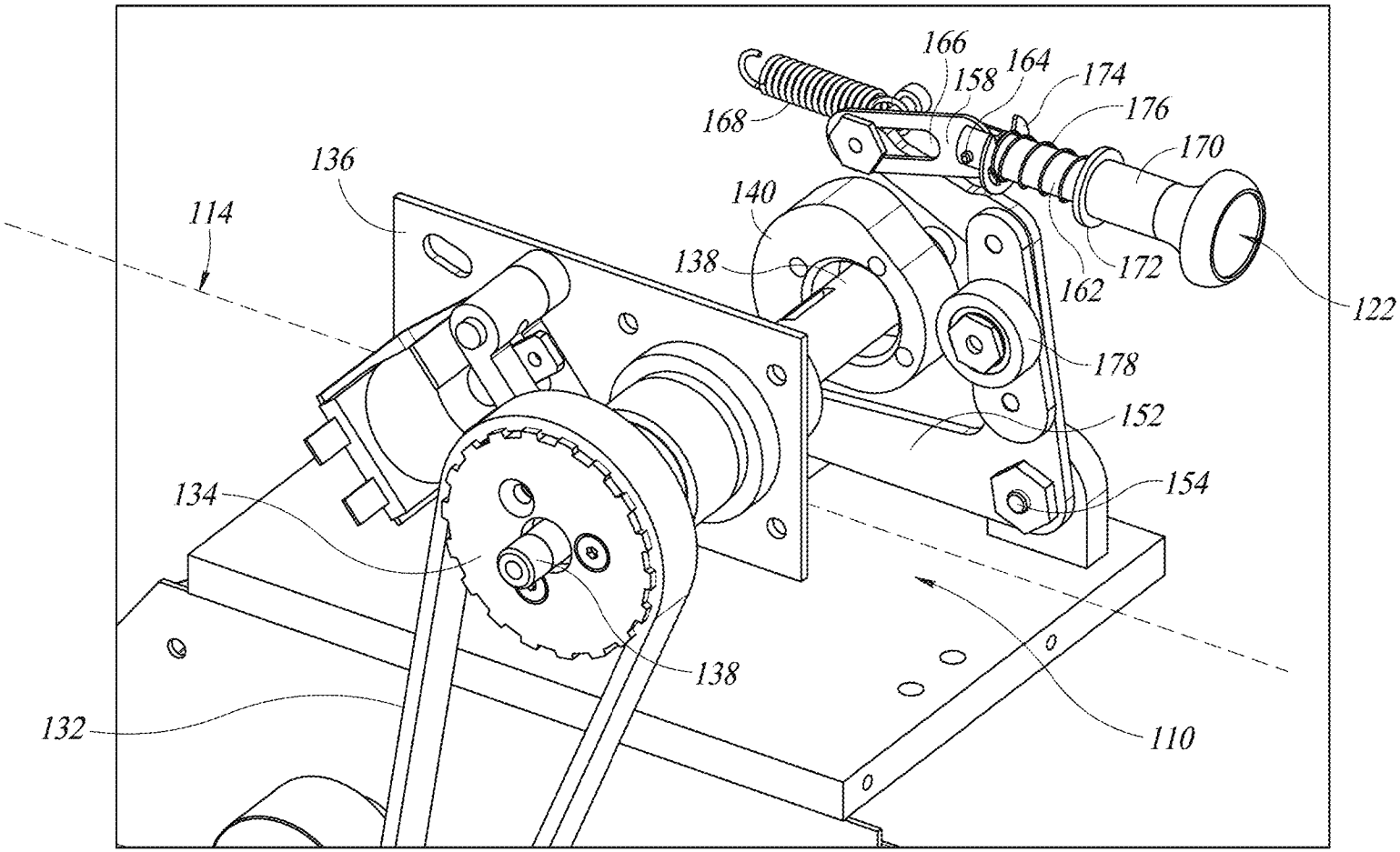
FIG. 8 illustrates a rear, top, and left side perspective view of the bag closure machine of FIGS. 1 and 2 with some components removed to show additional internal components governing operation and timing of the mechanical bag closure breakoff assembly.
Figure 9:
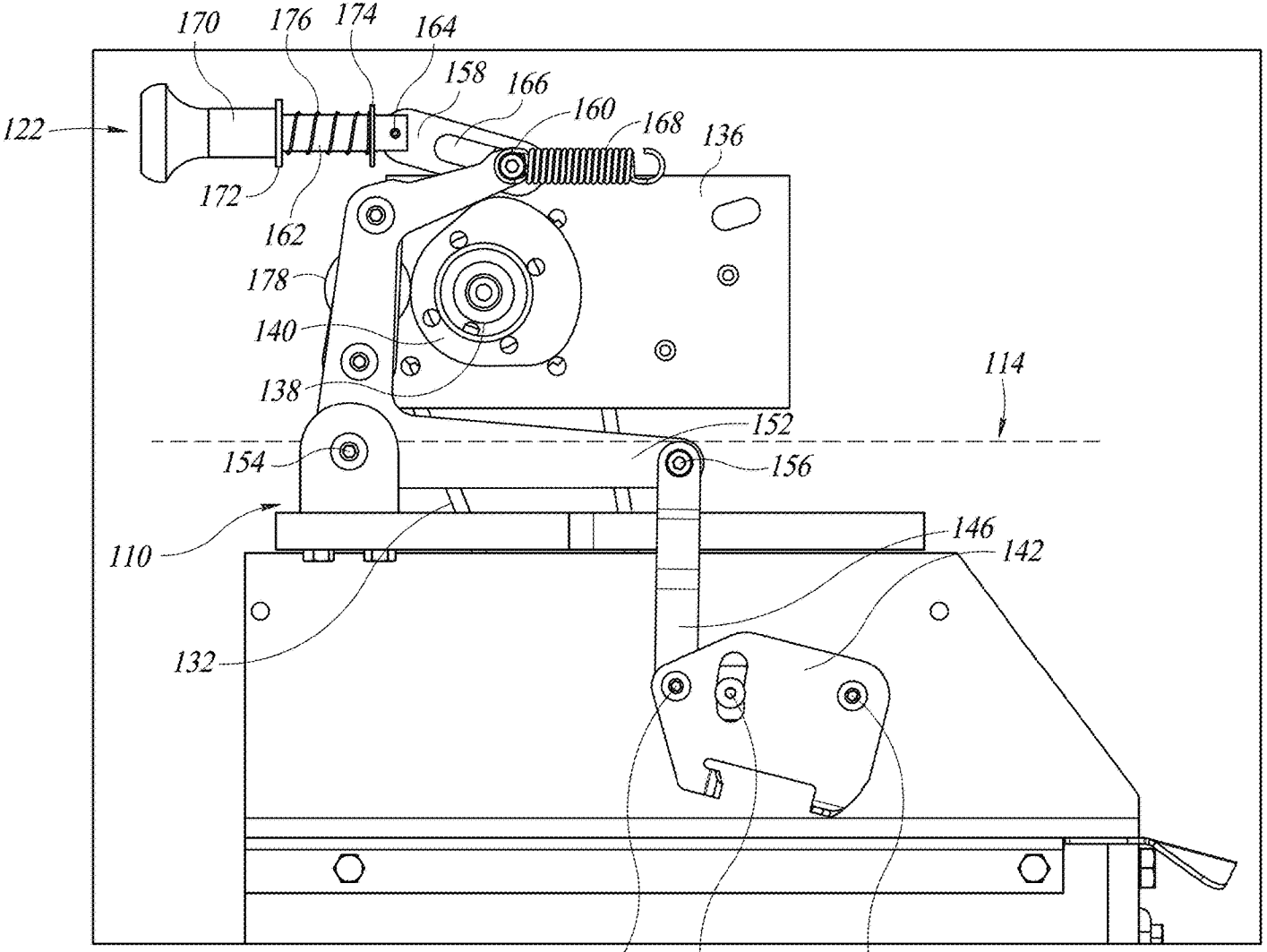
FIG. 9 illustrates a front view of the bag closure machine of FIGS. 1 and 2 with some components removed to show additional internal components governing operation and timing of the mechanical bag closure breakoff assembly.
Figure 10:
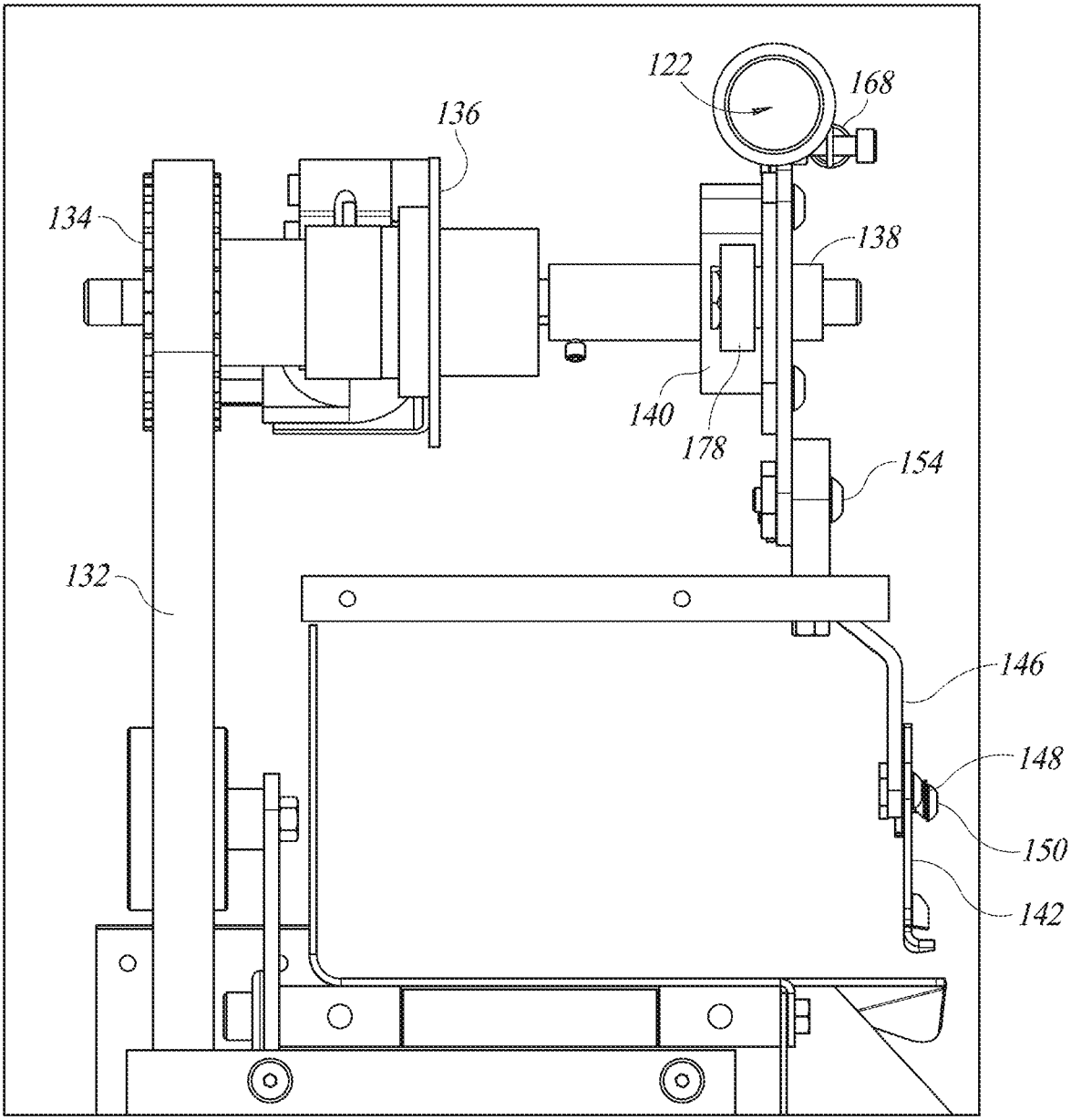
FIG. 10 illustrates a left side view of the bag closure machine of FIGS. 1 and 2 with some components removed to show additional internal components governing operation and timing of the mechanical bag closure breakoff assembly.
Figure 11:
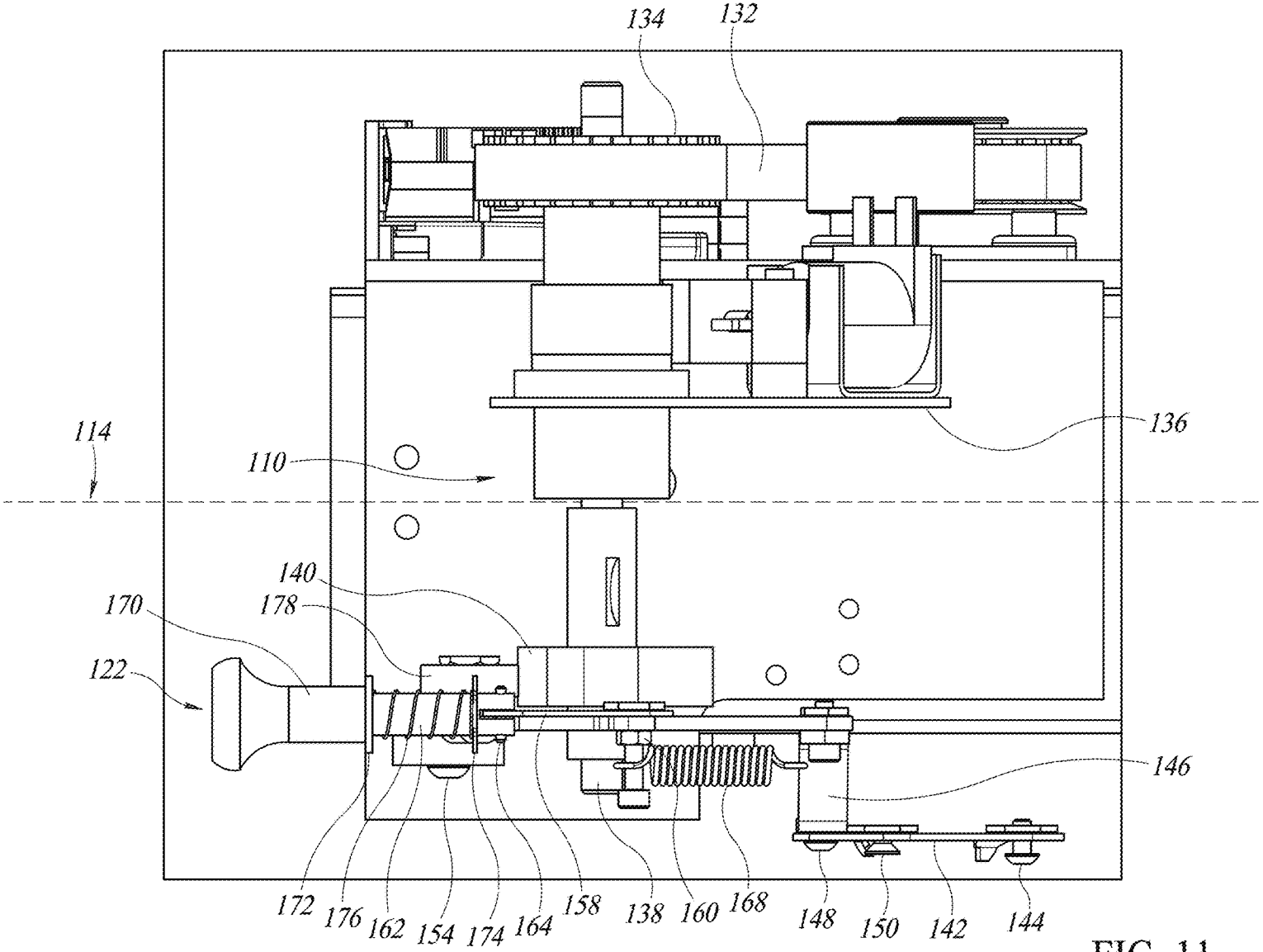
FIG. 11 illustrates a top plan view of the bag closure machine of FIGS. 1 and 2 with some components removed to show additional internal components governing operation and timing of the mechanical bag closure breakoff assembly.

In particular, as illustrated in FIGS. 7 and 8, the bag closure breakoff assembly includes a wheel 178 rotatably mounted to a mid-portion of the vertical arm of the driving lever 152, such that the wheel 178 can freely rotate or spin with respect to the driving lever 152, but cannot move or translate with respect to the driving lever 152. During normal operation of the device 100, the first spring 168 biases the driving lever 152 such that the wheel 178 is constantly in contact and engaged with and bears against the outer surface of the driving cam 140. In the configuration illustrated in FIGS. 5-11, as can be seen in the front view of FIG. 9 in particular, the wheel 178 is engaged with a heel portion of the cam 140. When the cam 140 rotates about its axis of rotation, however, the profile of the outer surface of the cam, and the changing distance from the portion of the outer surface of the cam 140 engaged with the wheel 178 to the axis of rotation of the cam 140, causes the wheel 178 to move toward and/or away from the axis of rotation of the cam 140. Because the wheel 178 is initially engaged with the heel portion of the cam 140, one full 360 degree rotation of the cam 140 will cause the wheel 178 to first move away from the axis of rotation of the cam 140 and to then move toward the axis of rotation of the cam 140.

Because the wheel 178 is mounted on the driving lever 152 such that the wheel 178 cannot move or translate with respect to the driving lever 152, movement of the wheel 178 away from the axis of rotation of the cam 140 causes the driving lever 152 to rotate counter-clockwise about the pivot point 154, to move the first linkage 146 upwards, and to cause the breakoff lever 142 to rotate clockwise, such as to break off a bag closure, and subsequent movement of the wheel 178 toward the axis of rotation of the cam 140 causes the driving lever 152 to rotate clockwise about the pivot point 154, to move the first linkage 146 downwards, to cause the breakoff lever 142 to rotate counter-clockwise, such as to return the breakoff lever 142 to its original, resting, neutral, or baseline position.

The profile of the outer surface of the cam 140 is carefully configured to ensure proper operation and timing of the breakoff assembly and to ensure coordination of the operation and timing of the breakoff assembly with other components of the device 100. For example, in an original, resting, neutral, or baseline position, in which the cam 140 is not moving or rotating, the cam 140 is configured such that the wheel 178, which may also be a roller bearing 178 or a cam follower 178, is engaged with the heel of the cam 140 and a base circle of the cam 140, which has a ¾ inch radius from the axis of rotation of the cam 140. Once the PLC sends a signal to activate the clutch 136 to engage and to initiate a cycle of the cam 140 as described herein, the wheel 178 continues to engage the base circle of the cam 140 over 30 degrees of rotation (or between 25 and 35, or 28 and 32, or 29 and 31 degrees of rotation) of the cam 140 (referred to as a "dwell"). Thereafter, the wheel 178 engages a linear opening ramp of the cam 140 over the next 30 degrees of rotation (or between 25 and 35, or 28 and 32, or 29 and 31 degrees of rotation) of the cam 140. Thereafter, the wheel 178 engages a transitional opening flank of the cam 140 over the next 30 degrees of rotation (or between 25 and 35, or 28 and 32, or 29 and 31 degrees of rotation) of the cam 140.

Thereafter, the wheel 178 engages a nose of the cam 140, which has a maximum radius of 1 inch from the axis of rotation of the cam 140, over the next 100 degrees of rotation (or between 90 and 110, or 95 and 105, or 98 and 102, or 99 and 101 degrees of rotation) of the cam 140. Thereafter, the wheel 178 engages a transitional closing flank of the cam 140 over the next 30 degrees of rotation (or between 25 and 35, or 28 and 32, or 29 and 31 degrees of rotation) of the cam 140. Thereafter, the wheel 178 engages a linear closing ramp of the cam 140 over the next 30 degrees of rotation (or between 25 and 35, or 28 and 32, or 29 and 31 degrees of rotation) of the cam 140. Thereafter, the wheel 178 engages the heel and the base circle of the cam 140 over the next and final 110 degrees of rotation (or between 100 and 120, or 105 and 115, or 108 and 112, or 109 and 111 degrees of rotation) of the cam 140.

Thus, when the cam 140 is not rotating, a heel of the cam 140 is mechanically engaged with the breakoff lever 142. The cam 140 has a profile shaped such that, when the cam 140 rotates, the heel of the cam 140 mechanically engages the breakoff lever 142 from its original, resting, neutral, or baseline position to 30 degrees of rotation (or between 25 and 35, or 28 and 32, or 29 and 31 degrees of rotation) of the cam 140. The cam 140 also has a profile shaped such that, when the cam 140 rotates, a linear opening ramp of the cam 140 mechanically engages the breakoff lever 142 from 30 degrees of rotation (or between 25 and 35, or 28 and 32, or 29 and 31 degrees of rotation) of the cam 140 to 60 degrees of rotation (or between 55 and 65, or 58 and 62, or 59 and 61 degrees of rotation) of the cam 140. The cam 140 also has a profile shaped such that, when the cam 140 rotates, a transitional opening flank of the cam 140 mechanically engages the breakoff lever 142 from 60 degrees of rotation (or between 55 and 65, or 58 and 62, or 59 and 61 degrees of rotation) of the cam 140 to 90 degrees of rotation (or between 85 and 95, or 88 and 92, or 89 and 91 degrees of rotation) of the cam 140. The cam 140 also has a profile shaped such that, when the cam 140 rotates, a nose of the cam 140 mechanically engages the breakoff lever 142 from 90 degrees of rotation (or between 85 and 95, or 88 and 92, or 89 and 91 degrees of rotation) of the cam 140 to 190 degrees of rotation (or between 185 and 195, or 188 and 192, or 189 and 191 degrees of rotation) of the cam 140. The cam 140 also has a profile shaped such that, when the cam 140 rotates, a transitional closing flank of the cam 140 mechanically engages the breakoff lever 142 from 190 degrees of rotation (or between 185 and 195, or 188 and 192, or 189 and 191 degrees of rotation) of the cam 140 to 220 degrees of rotation (or between 215 and 225, or 218 and 222, or 219 and 221 degrees of rotation) of the cam 140. The cam 140 also has a profile shaped such that, when the cam 140 rotates, a linear closing ramp of the cam 140 mechanically engages the breakoff lever 142 from 220 degrees of rotation (or between 215 and 225, or 218 and 222, or 219 and 221 degrees of rotation) of the cam 140 to 250 degrees of rotation (or between 245 and 255, or 248 and 252, or 249 and 251 degrees of rotation) of the cam 140. The cam 140 also has a profile shaped such that, when the cam 140 rotates, the heel of the cam 140 mechanically engages the breakoff lever 142 from 250 degrees of rotation (or between 245 and 255, or 248 and 252, or 249 and 251 degrees of rotation) of the cam 140 to 360 degrees of rotation of the cam 140, and thus back to the neutral position.

It has been found to be advantageous to separate or break the bottom-most one of the bag closures off of the elongate strip of connected bag closures as early as possible in a bag closure cycle, at least because the bags are generally being carried by a continuously-moving conveyor belt, such that holding the bags back increases the chances of damaging the bags, or requires slowing down the conveyor belt to avoid such damage. It has been found that the 30 degree dwell and the 90 degree rotation needed to reach the nose of the cam 140 described herein is sufficient to compensate for variation in operation of the various components of the device 100, while minimizing the time between initiation of the cycle and the separation of the bottom-most bag closure from the elongate strip of connected bag closures.

It has also been found to be advantageous to make the nose of the cam 140 extend over as large a portion of the cam 140 as possible, to provide as much time as possible for the closed bag to be carried out of the machine 100 before the breakoff lever 142 returns to its original, resting, neutral, or baseline position, to reduce the chance that the bag or the bag closure are caught by the breakoff lever 142 as it returns, or once it has returned, to its original, resting, neutral, or baseline position. Nevertheless, the breakoff lever 142 must return to its original, resting, neutral, or baseline position with sufficient time left for the mechanical bag closure advancement assembly to advance the next bag closure to be ready to close the next bag. It has been found that the 250 degree rotation needed to reach the heel and the base circle of the cam 140 described herein is particularly advantageous because it represents the same degree of rotation of the driven shaft 138 (between 245 and 255 degrees, between 248 and 252 degrees, between 249 and 251 degrees, or 250 degrees) at which a cycle of the mechanical bag closure advancement assembly is initiated to advance the elongate strip of connected bag closures and the next bag closure in particular, into a position that would otherwise be occupied by the breakoff lever 142.

When the bag closure device 100 is operating and applying bag closures to a plurality or series of bags pre-filled with food items, the PLC can repeatedly or periodically send signals to the clutch 136 to separate or break the bottom-most one of the bag closures from the elongate strip of connected bag closures. Upon receipt of such a signal, the clutch 136 can engage the gear or wheel 134 to the driven shaft 138, such that rotation or torque, or power, is transferred from the gear or wheel 134 to the driven shaft 138, such that the driven shaft 138 rotates counter-clockwise when viewed from the front for exactly one single full rotation, or 360 degrees, and the clutch 136 can then disengage the gear or wheel 134 from the driven shaft 138 until the next such signal is received from the PLC. This can represent what can be referred to as "normal" or "ordinary" operation of the device 100 and the breakoff assembly. During such operation of the device 100, the driving lever 152 oscillates back and forth, but because the screw, bolt, or pin 160 can move and oscillate freely within and through the slot 166, oscillation of the components of the breakoff assembly do not result in oscillation or any discernable movement of the second knob 122 outside of the housing 118. Thus, the second knob 122 can be stationary during normal operation of the device 100 and the breakoff assembly.

If at any time during operation of the device 100 a human operator determines or decides that it would be advantageous to manually separate or break the bottom-most one of the bag closures off of the elongate strip of connected bag closures, the human operator can pull the second knob 122 leftward and outward from the housing 118, which can actuate the breakoff lever 142 to break off the bottom-most one of the bag closures. Such manual separation may result in the wheel 178 being separated from the cam 140, but upon the human operator releasing the second knob 122, the springs described herein return the components to their original, resting, neutral, or baseline positions and re-engage the wheel 178 with the cam 140, such that normal operation of the machine 100 can be resumed. Such manual operation of the knob 122 may also result in the breakoff lever 142 blocking a path of the bottom-most one of the elongate strip of connected bag closures when the pick 182 next attempts to advance the elongate strip of connected bag closures downward. In some embodiments, the machine 100, and the mechanical bag closure advancement assembly in particular, can include a slip clutch or other torque limiter so that the advancement of the elongate strip of connected bag closures can be interrupted, stopped, or halted in such conditions, thereby preventing or reducing the chances of damage to or jamming of the elongate strip of connected bag closures.

Figure 12:
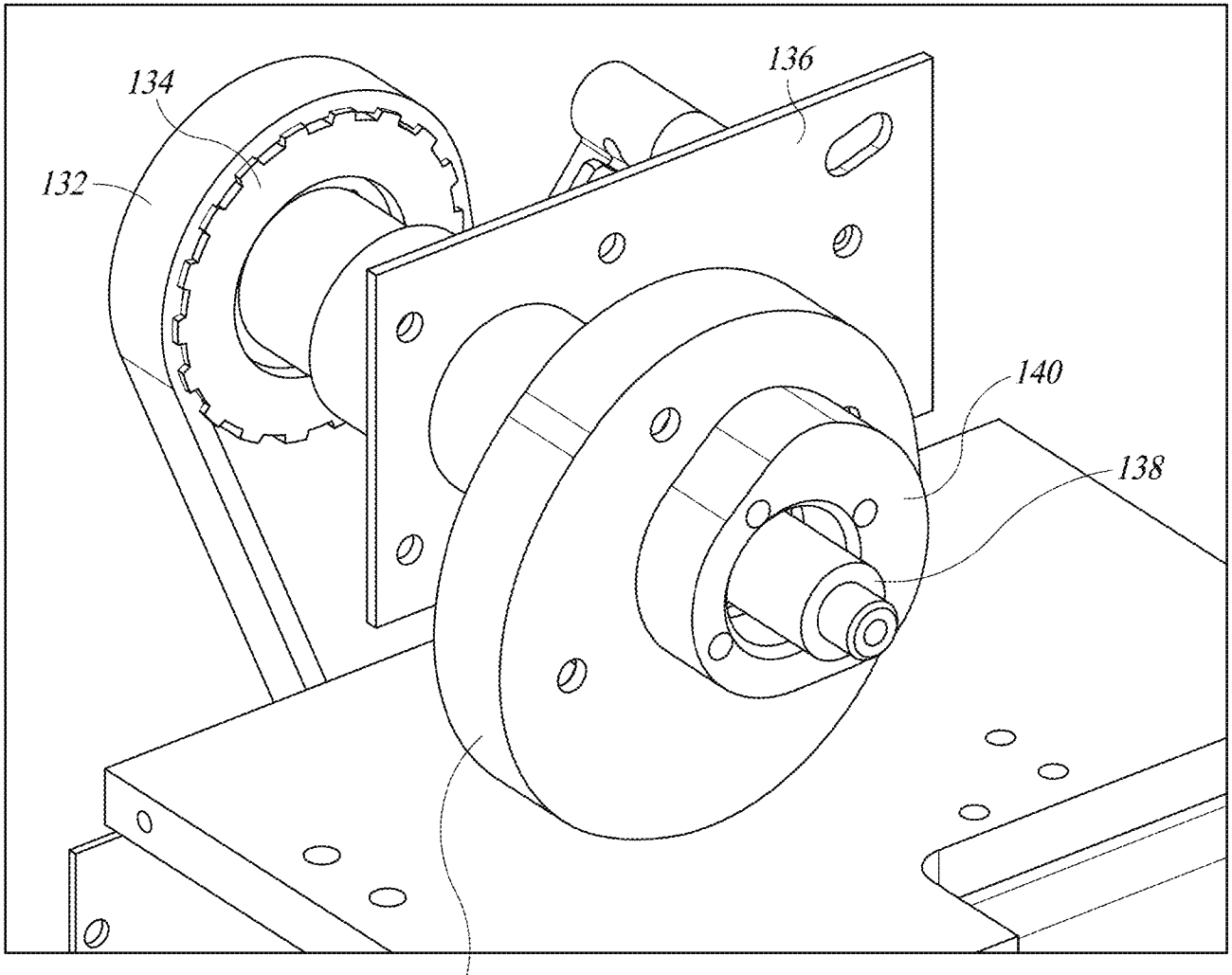
FIG. 12 illustrates a front, top, and left side perspective view of the bag closure machine of FIGS. 1 and 2 with some components removed to show additional internal components governing timing of the mechanical bag closure breakoff assembly and a mechanical bag closure advancement assembly.
Figure 13:
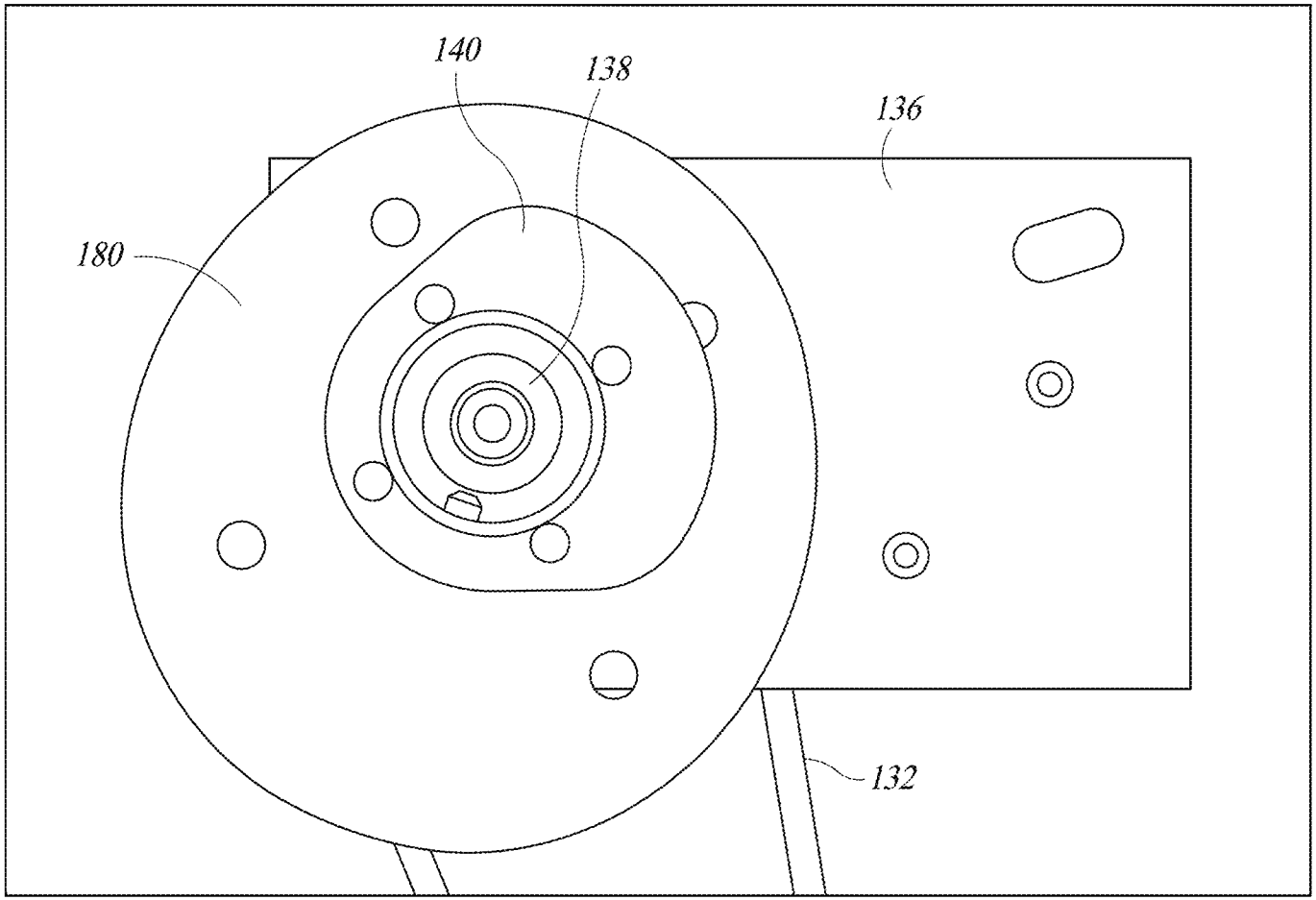
FIG. 13 illustrates a front view of the bag closure machine of FIGS. 1 and 2 with some components removed to show additional internal components governing timing of the mechanical bag closure breakoff assembly and the mechanical bag closure advancement assembly.
Figure 14:
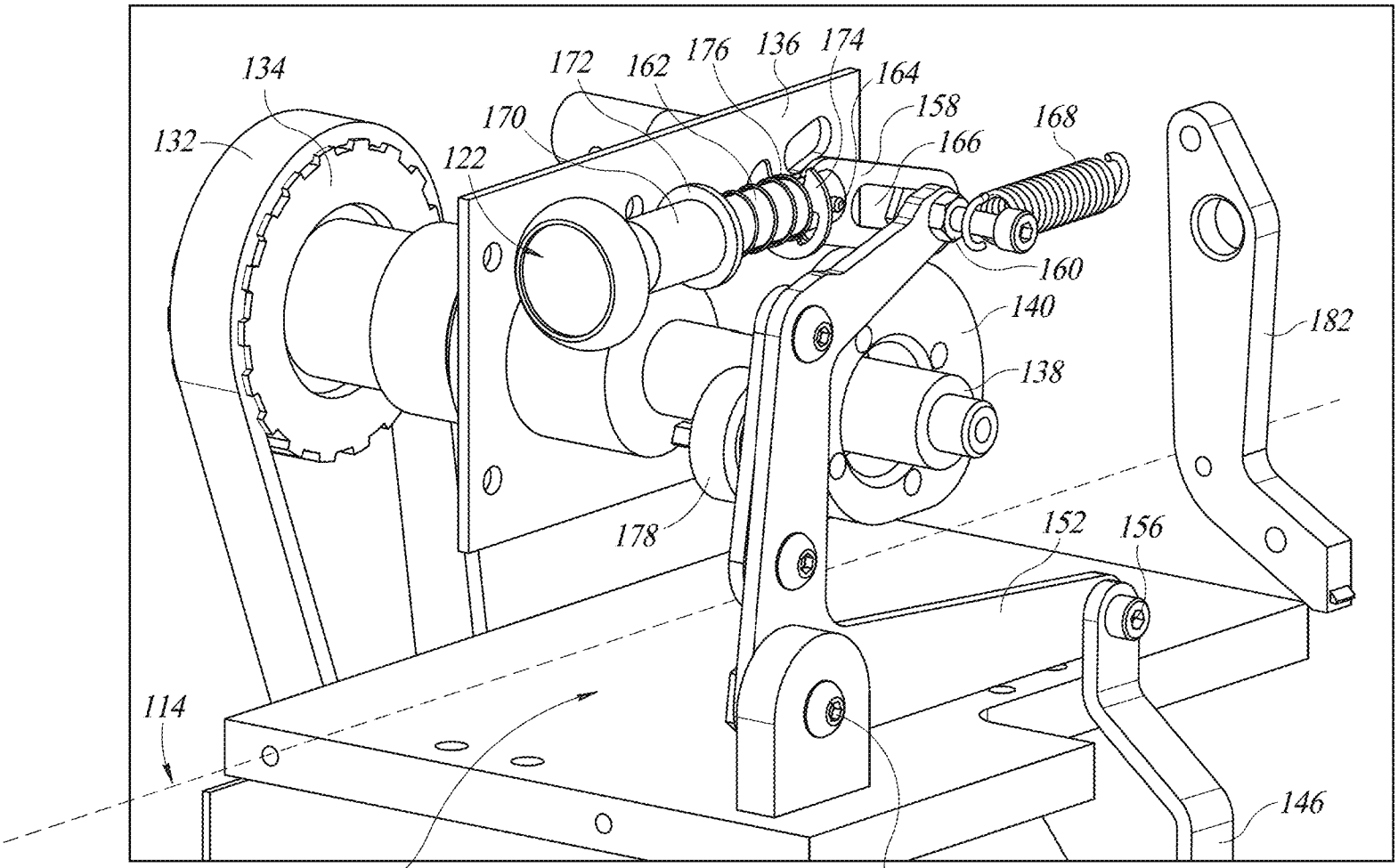
FIG. 14 illustrates a front, top, and left side perspective view of the bag closure machine of FIGS. 1 and 2 with some components removed to show additional internal components governing operation and timing of the mechanical bag closure breakoff assembly and of the mechanical bag closure advancement assembly.

FIGS. 12 and 13 illustrate different views of the bag closure machine 100 with components thereof, including the top portion of the housing 118 and other components housed therein, removed, to illustrate other components in greater detail. In particular, FIGS. 12 and 13 illustrate a second cam 180 securely and rigidly mounted on the driven shaft 138, such that it rotates synchronously with the cam 140. In some embodiments, the second cam 180 controls the operation and timing of the cycle of the mechanical bag closure advancement assembly that is configured to advance the elongate strip of connected bag closures along the axis 116. FIG. 13 in particular illustrates the profiles of the cam 140 and the second cam 180 with respect to one another. FIG. 14 illustrates a perspective view of the bag closure machine 100 with components thereof, including the top portion of the housing 118 and other components housed therein, removed, to illustrate other components in greater detail. In particular, FIG. 14 illustrates a pick 182 of the mechanical bag closure advancement assembly that may be actuated by operation of the second cam 180 to reciprocate or repeatedly move up and down, where a tip of the pick 182 may engage the elongate strip of connected bag closures and carry the elongate strip of connected bag closures downward on its down stroke.

Various components of the mechanical bag closure breakoff assembly and the mechanical bag closure advancement assembly are described herein as rotatable in a global sense and/or with respect to one another. Unless the context clearly indicates otherwise, the axes of such rotations may be coincident or parallel, or aligned with or substantially aligned with, one another, as well as with a horizontal axis extending front-to-back and perpendicularly to the axis 114 of the channel 110 and to the vertical axis 116 along which the elongate strip of connected bag closures travels when the machine 100 is in use.

Figure 15:
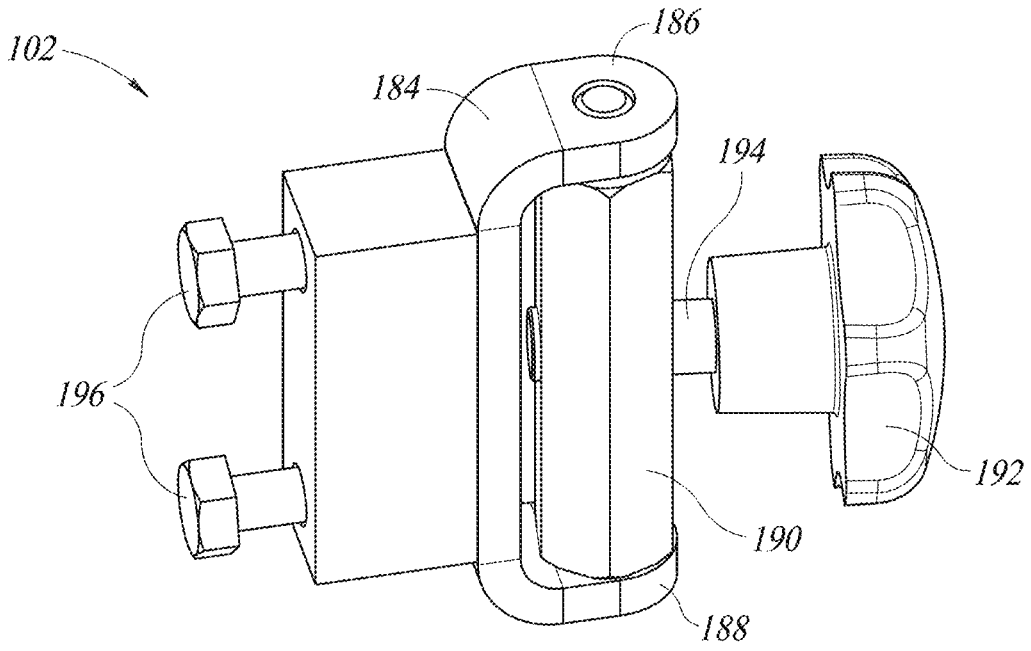
FIG. 15 illustrates a front, top, and left side perspective view of a first portion of a mounting system of the bag closure machine of FIGS. 1 and 2.
Figure 16:
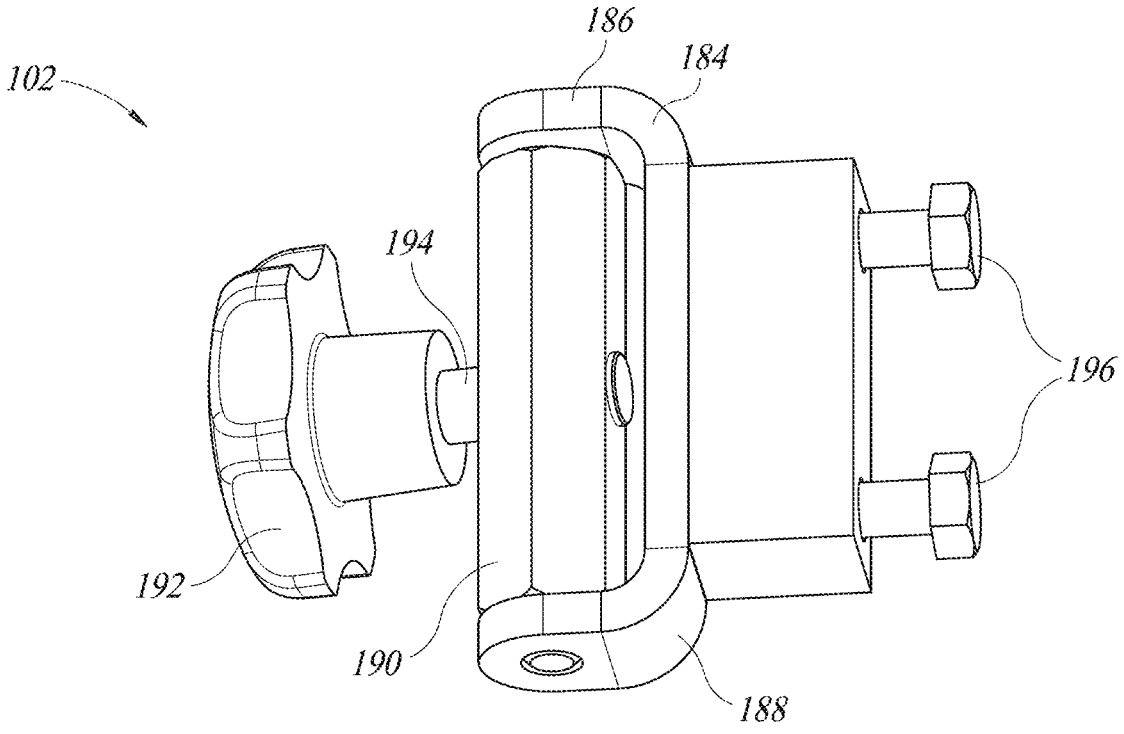
FIG. 16 illustrates a rear, bottom, and left side perspective view of the first portion of the mounting system of the bag closure machine of FIGS. 1 and 2.

FIGS. 15 and 16 illustrate different views of the first portion 102 of the mounting system that facilitates mounting the device 100 to other systems within a production and/or packaging facility, such as to a conveyor or conveyor belt therein. As illustrated in FIGS. 15 and 16, the first portion 102 of the mounting system includes a C-shaped bracket 184 that is directly and rigidly coupled to the right side surface of the right side wall of the bottom portion of the housing 118, such as by a pair of bolts, screws, or other fasteners 196. The bracket 184 has a first, upper horizontal arm 186 and a second, lower horizontal arm 188 directly below the first, upper horizontal arm 186, where each of the upper and lower horizontal arms 186, 188 extend parallel to one another, rightward and outward away from the housing 118. The first portion 102 of the mounting system also includes a shaft 190 that extends vertically from the upper horizontal arm 186 to the lower horizontal arm 188 that is rotatably coupled at a top end thereof directly to the upper horizontal arm 186, and that is rotatably coupled at a bottom end thereof directly to the lower horizontal arm 188, such that the shaft 190 can rotate about a vertical axis with respect to the bracket 184 and the housing 118 of the machine 100. Thus, the bracket 184 and the shaft 190 together form a hinge having a vertical axis of rotation.

As further illustrated in FIGS. 15 and 16, the first portion 102 of the mounting system also includes a knob 192 coupled to the shaft 190 by a partially threaded, horizontal rod 194, such that the knob 192 can be turned, such as by a human operator, to thread the knob either toward or away from the shaft 190. When the machine 100 is in use, it may be coupled to a conveyor system. The conveyor system may include a rail hinged to rotate about a vertical axis of rotation with respect to a conveyor belt thereof. When the machine 100 is in use, a portion of the partially threaded rod 194, such as an un-threaded portion thereof between the shaft 190 and the knob 192, may be mounted on or otherwise engaged with the rail. The knob 192 can be turned such that it moves away from the shaft 190 until the partially threaded rod 194 is free to travel, slide, or ride longitudinally along the rail. In such a configuration, the first portion 102 of the mounting system, and the rest of the machine 100 coupled thereto, can also travel, slide, or ride longitudinally along the rail. Such a configuration may be referred to as a released or unconstrained configuration.

The knob 192 can also be turned such that it moves toward the shaft 190 until the rail is pinched or sandwiched between the knob 192 and the shaft 190. In such a configuration, the rod 194, the first portion 102 of the mounting system, and the rest of the machine 100 can no longer travel, slide, or ride longitudinally along the rail. Such a configuration may be referred to as a constrained configuration. Regardless of the location of the knob 192, the bracket 184 and the rest of the machine 100 coupled thereto can rotate about the hinge formed by the upper and lower horizontal arms 186, 188, and the shaft 190, and/or the first portion 102 of the mounting system and the rest of the machine 100 coupled thereto can rotate about the hinge between the rail of the conveyor system and the rest of the conveyor system, including the conveyor belt thereof.

Figure 17:
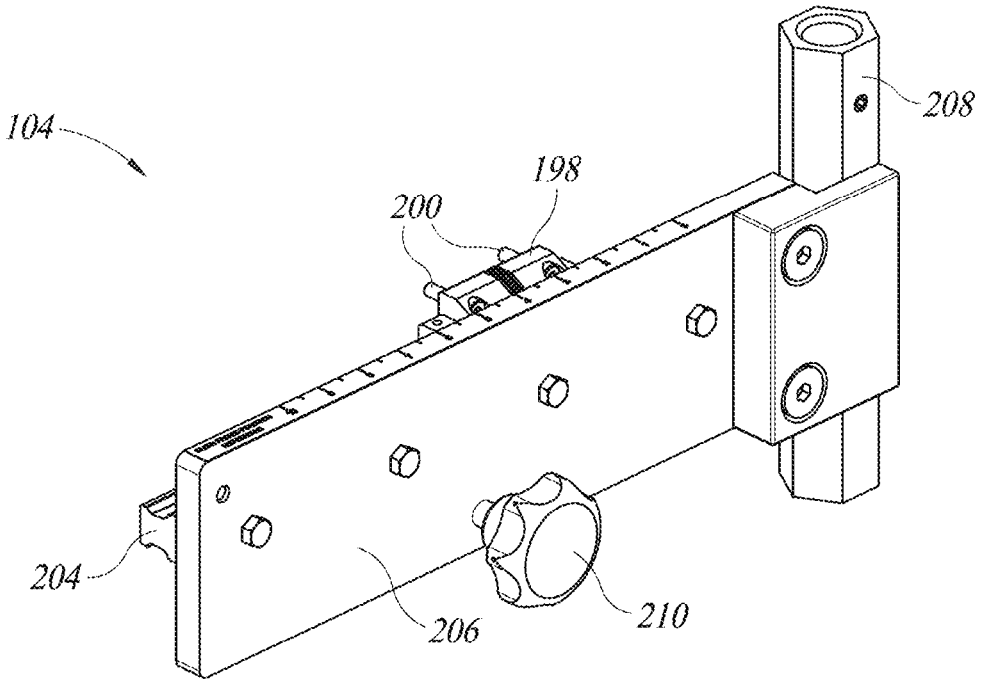
FIG. 17 illustrates an outer perspective view of a second portion of the mounting system of the bag closure machine of FIGS. 1 and 2.
Figure 18:
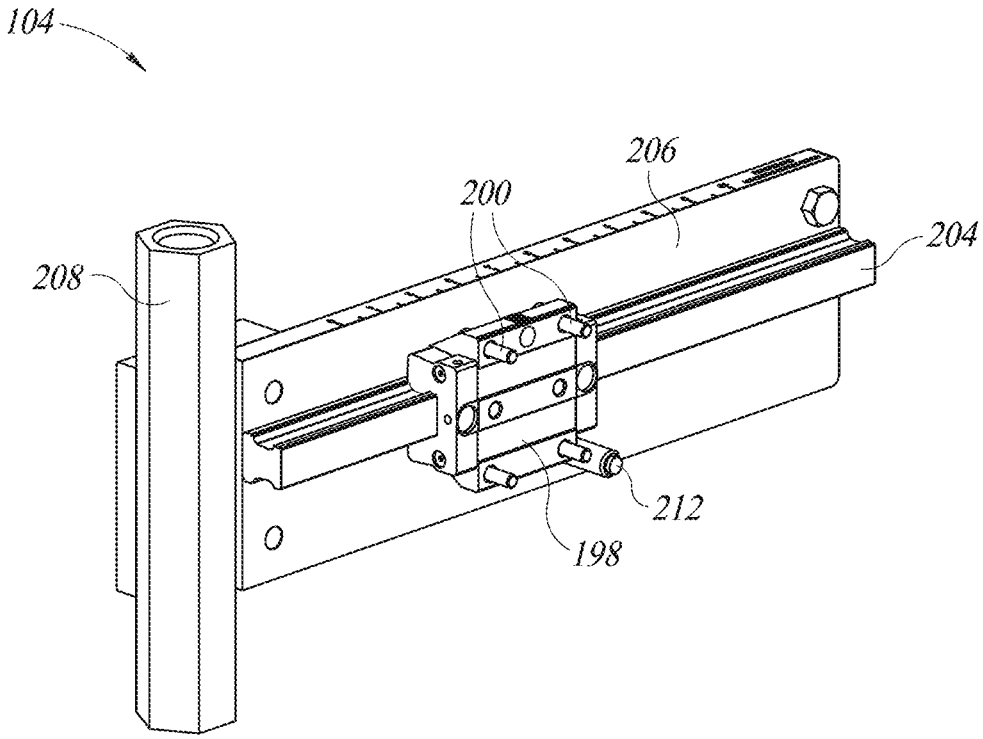
FIG. 18 illustrates an inner perspective view of the second portion of the mounting system of the bag closure machine of FIGS. 1 and 2.
Figure 19:
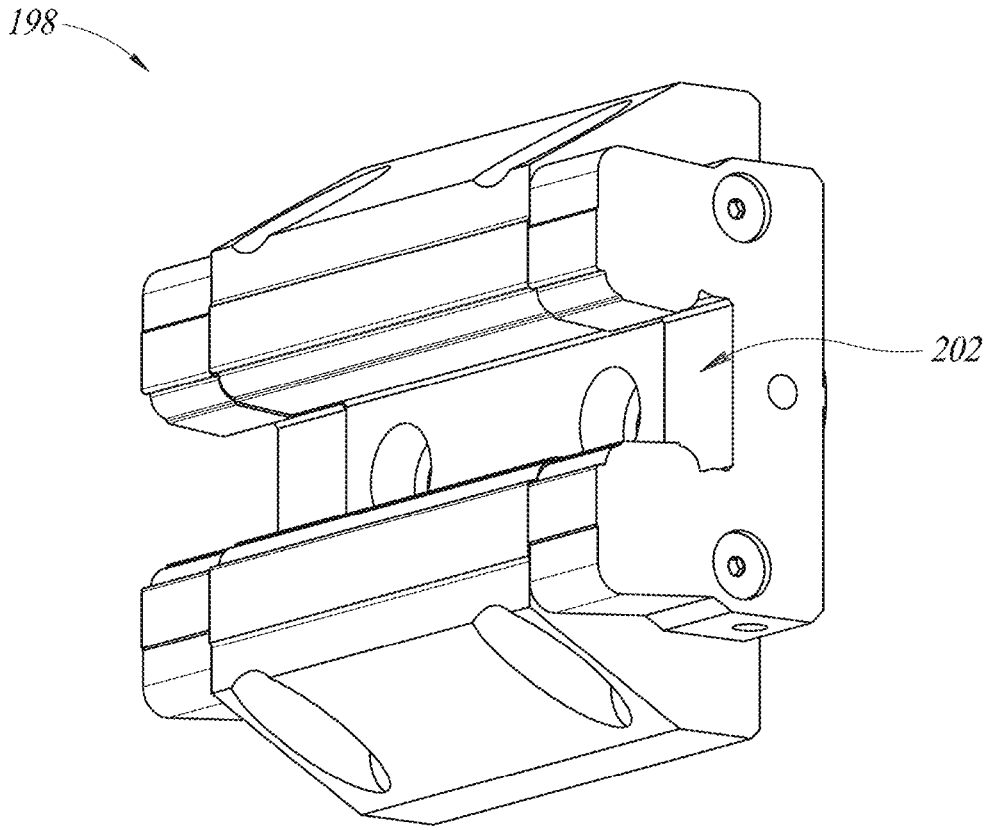
FIG. 19 illustrates a perspective view of a carriage of the second portion of the mounting system of the bag closure machine of FIGS. 1 and 2.
Figure 20:
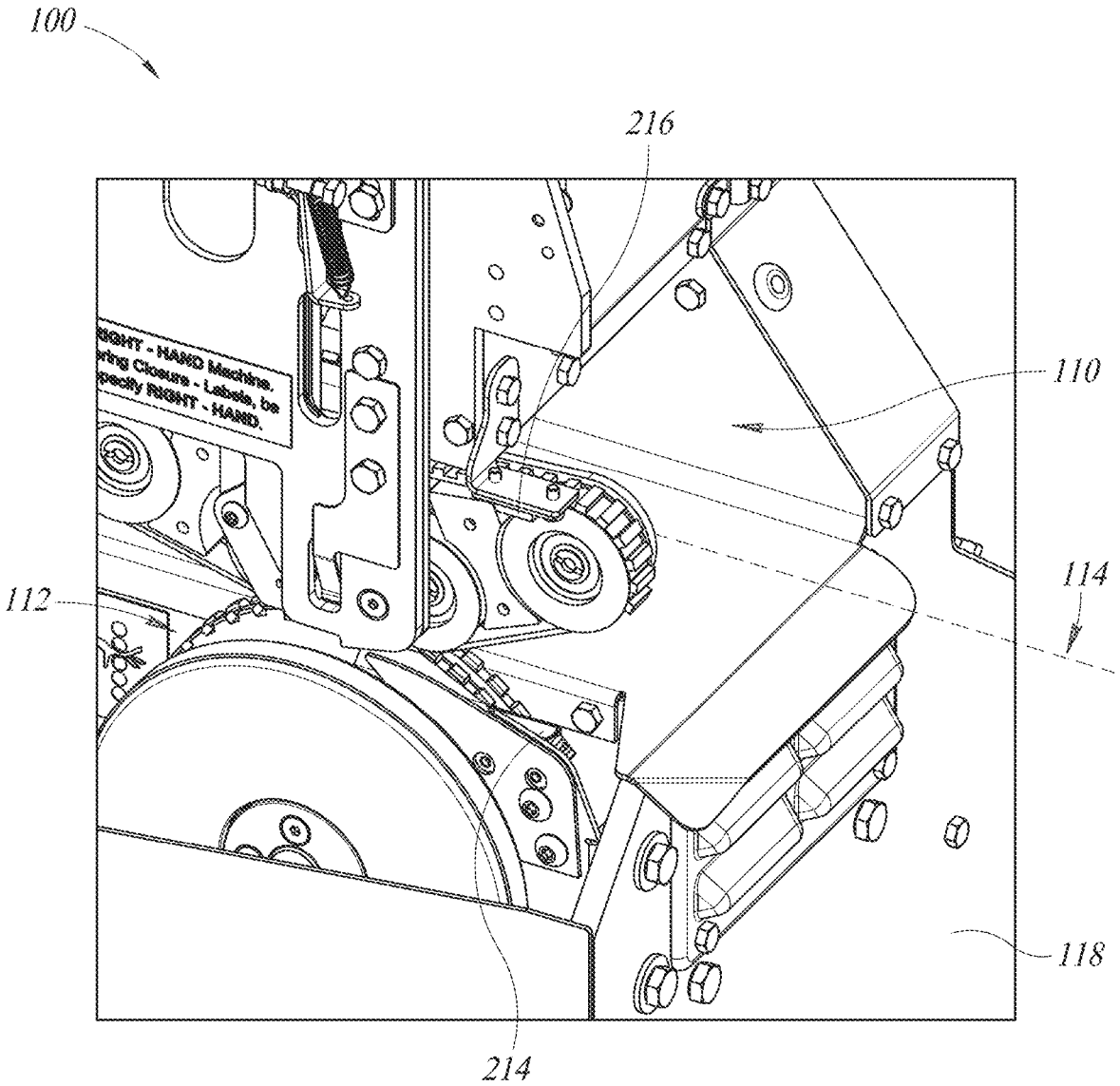
FIG. 20 illustrates a front, top, and right side perspective view of the bag closure machine of FIGS. 1 and 2 with some components removed to show additional components for detection of a passing bag.
Figure 21:
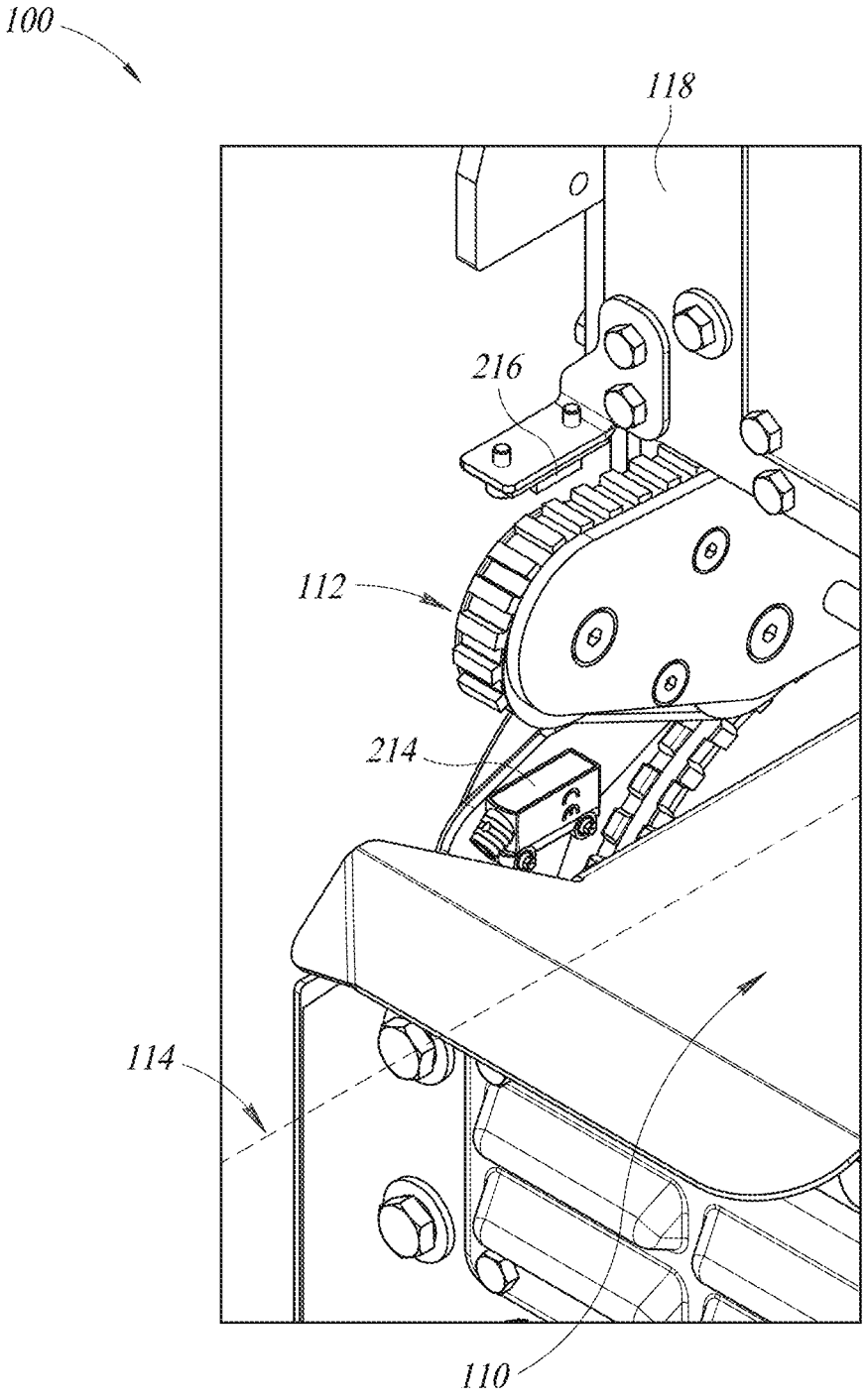
FIG. 21 illustrates a rear, top, and right side perspective view of the bag closure machine of FIGS. 1 and 2 with some components removed to show the additional components for detection of a passing bag.
Figure 22:
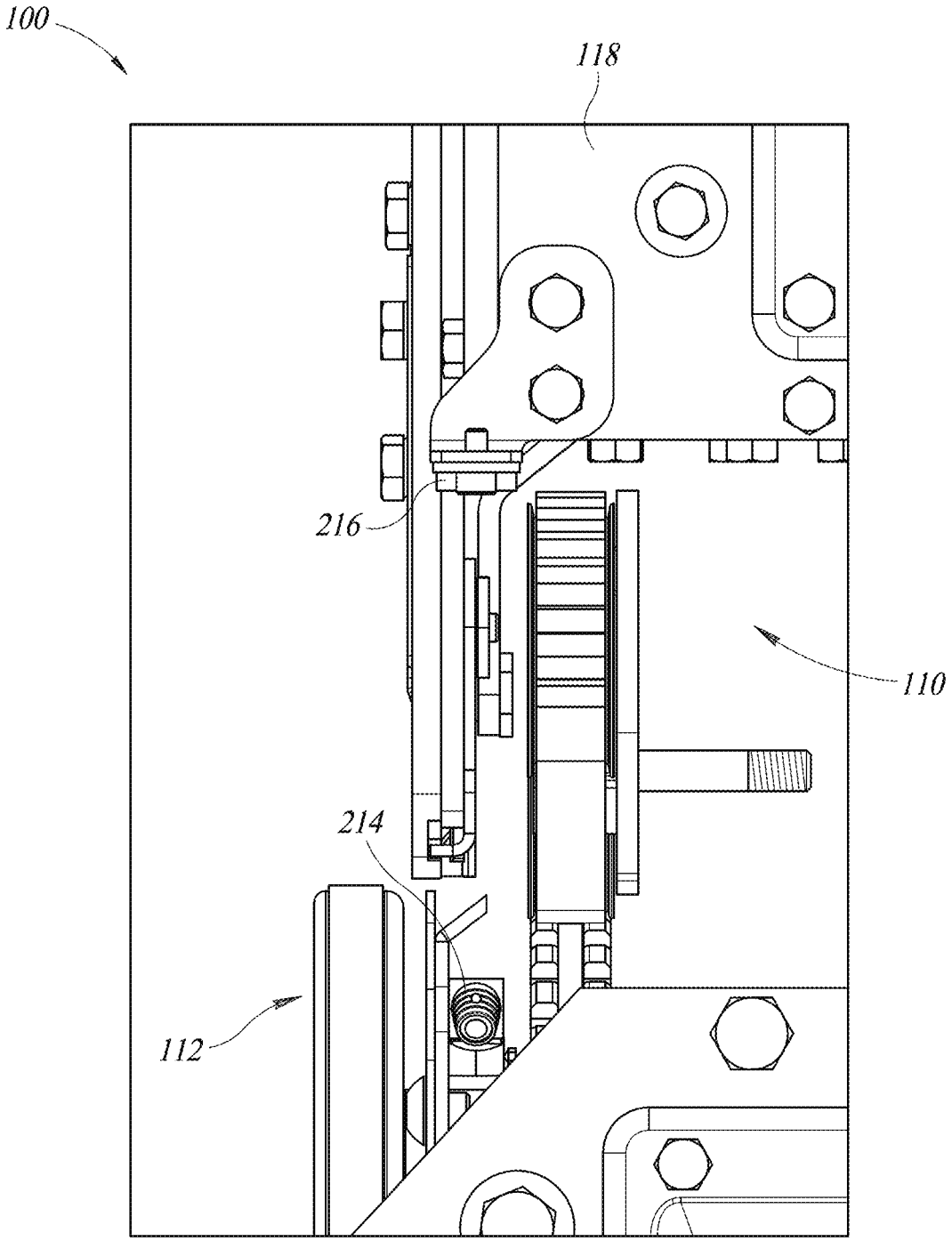
FIG. 22 illustrates a right side view of the bag closure machine of FIGS. 1 and 2 with some components removed to show the additional components for detection of a passing bag.
Figure 23:
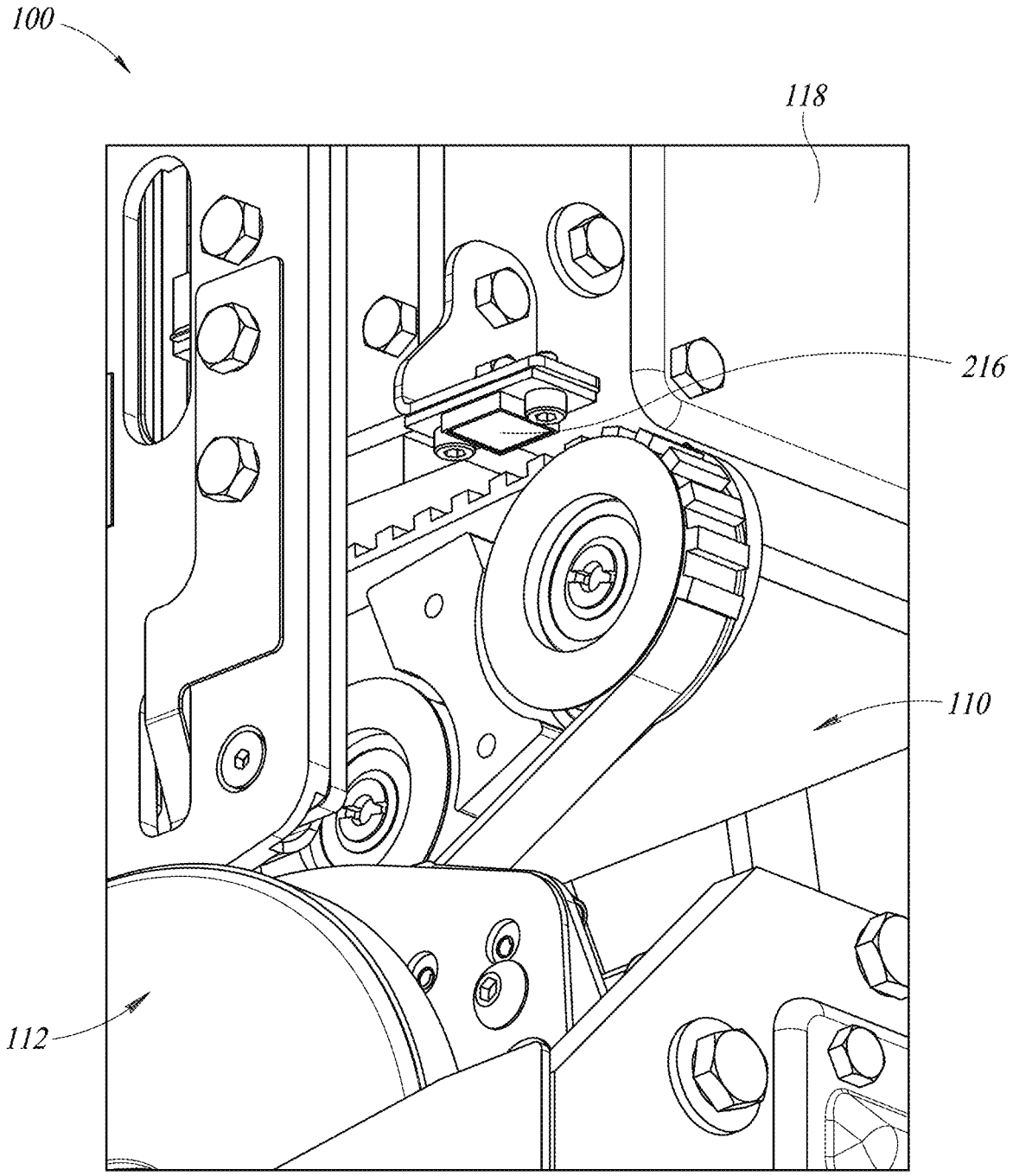
FIG. 23 illustrates a front, bottom, and right side perspective view of the bag closure machine of FIGS. 1 and 2 with some components removed to show the additional components for detection of a passing bag.

FIGS. 17 and 18 illustrate different views of the second portion 104 of the mounting system that facilitates mounting the device 100 to other systems within a production and/or packaging facility, such as to a conveyor or conveyor belt therein. As illustrated in FIGS. 17 and 18, the second portion 104 of the mounting system includes a carriage 198 that is directly and rigidly coupled to the left side surface of the left side wall of the bottom portion of the housing 118, such as by a set of bolts, screws, or other fasteners 200. The carriage 198, which is shown by itself and in greater detail in FIG. 19, has a horizontally-extending, doubly-undercut groove 202 that extends front-to-back and parallel to the left side wall of the bottom portion of the housing 118. The second portion 104 of the mounting system also includes a shaft or rail 204 that extends through the groove 202 of the carriage 198, and which has a profile or cross-sectional shape along its length that includes a pair of protrusions configured to be seated within the undercuts in the doubly-undercut groove 202 when the rail 204 extends through the groove 202. Thus, the rail 204 is securely mounted within the groove 202 and thereby to the carriage 198 such that the rail 204 and the carriage 198 can move or translate longitudinally with respect to one another along an axis defined by the orientations of the rail 204 and the groove 202, and thus such that the rail 204 can move along the same axis with respect to the housing 118 of the machine 100.

As further illustrated in FIGS. 17 and 18, the second portion 104 of the mounting system also includes a plate 206 securely and rigidly coupled to the rail 204, a vertically-extending hollow sleeve 208 securely and rigidly coupled to the plate 206, and a knob 210 coupled to the plate 206 by a threaded, horizontal rod 212. When the machine 100 is in use, it may be coupled to a conveyor system. The conveyor system may include a first vertically-extending cylindrical rod extending through the hollow sleeve 208, such that the hollow sleeve 208 is hinged to rotate about a vertical axis of rotation with respect to a conveyor belt thereof. Thus, the hollow sleeve 208 and the cylindrical rod together form a hinge having a vertical axis of rotation. When the machine 100 is in use, the knob 210 can be turned, such as by a human operator, to thread the knob 210 either inward or outward through the plate 206, toward or away from the left side wall of the bottom portion of the housing 118.

For example, the knob 210 can be turned such that it moves outward and away from the left side wall of the bottom portion of the housing 118 until the carriage 198 and the rest of the machine 100 coupled thereto and carried thereby are free to travel, slide, or ride longitudinally along the rail 204 and with respect to the plate 206, the sleeve 208, the knob 210, and the threaded rod 212. Such a configuration may be referred to as a released or unconstrained configuration. The knob 192 can also be turned such that it moves inward and toward the left side wall of the bottom portion of the housing 118 until a terminal distal end or tip of the threaded rod 212 engages with the outer left side surface of the left side wall of the bottom portion of the housing 118 such that the carriage 198 and the rest of the machine 100 coupled thereto and carried thereby are no longer free to travel, slide, or ride longitudinally along the rail 204 and with respect to the plate 206, the sleeve 208, the knob 210, and the threaded rod 212. Such a configuration may be referred to as a constrained configuration. Regardless of the configuration of the knob 210 and the threaded rod 212, the carriage 198 and the rest of the machine 100 coupled thereto and carried thereby, can also rotate about the hinge formed by the sleeve 208 and the cylindrical rod of the conveyor system.

To couple and mount the device 100 to a conveyor system, the partially threaded rod 194 is coupled to and mounted on the rail of the conveyor system and the sleeve 208 is coupled to and mounted on the cylindrical rod of the conveyor system. In such a configuration, with both of the knobs 192 and 210 turned to release or allow movement of the machine 100 with respect to the conveyor system, and in the unconstrained configuration, the machine 100 can simultaneously freely rotate with respect to the conveyor system, such as about a vertical axis, and freely translate with respect to the conveyor system, such as toward and away from the conveyor system. In such a configuration, the machine 100 can be said to have full fluid movement with respect to the conveyor system. Such movement may be advantageous because it allows an operator to adjust the location and orientation of the machine 100 with respect to the conveyor system, which allows the operator to adjust or optimize package or bag closure tightness, as well as to adjust or optimize the location at which bag closures are applied to the necks of the bags being closed.

FIGS. 20-23 illustrate different views of components for detection of a bag, which may be transparent, translucent, or opaque, or substantially transparent, substantially translucent, or substantially opaque, passing through the machine 100. As illustrated in FIGS. 20-23, the machine 100 and the bag detection components include an optical bag sensor 214, which may be a commercially available optical sensor such as that available under the name and model number SICK WL2SGC-2P3234A00, and which may be coupled to a guide or a guard component of the machine 100 proximate the channel 110. As further illustrated in FIGS. 20-23, the machine 100 and the bag detection components also include a corresponding optical reflector 216, which may be a commercially available optical reflector such as that available under the name and model number SICK PL7F, and which may be coupled to a right side outer surface of a right side wall of the upper portion of the housing 118.

In particular, the optical sensor 214 can be configured to emit light in specific wavelengths (e.g., infrared wavelengths) and at specific energy levels, in a directly upward or vertical direction toward the reflector 216. The reflector 216 can be positioned directly above the optical sensor 214 and can be configured and oriented to reflect the light emitted by the optical sensor 214 directly back, directly downward or vertically, toward the optical sensor 214. The optical sensor 214 can further be configured to receive, detect, and/or measure light in the same specific wavelengths (e.g., infrared wavelengths), such as that previously emitted by the optical sensor 214 and reflected and returned to it by the reflector 216. The optical sensor 214 and the reflector 216 are each selected for their ability to work with the specific wavelengths (e.g., infrared wavelengths) and energy levels of light needed or best suited for detection of bags, and transparent or substantially transparent bags in particular, travelling through the machine 100.

In some embodiments, the optical sensor 214 and the reflector 216 may be provided with driving software that allows them to be adjusted, such as to more effectively detect bags of different transparencies, or to compensate for interference from debris that builds up in the machine 100 over time (e.g., portions of the food items being packaged, such as bread crumbs). For example, the optical sensor 214 and the reflector 216 may be adjusted to be optimized for use with bags having a transparency (measured in some cases in terms of percentage transmittance of incident light) of greater than 75%, 80%, 85%, 90%, 95%, 98%, or 99%, and/or less than 80%, 85%, 90%, 95%, 98%, 99%, or 100%. It has been found that such optical detection systems, including the optical sensor 214 and the reflector 216, are more reliable and accurate than previous mechanical detection systems. For example, the optical systems can be adjusted, in some cases automatically, to compensate for the presence of debris or other interfering matter that has traditionally been problematic for mechanical systems.

As illustrated in FIGS. 20-23, the set of rotating wheels 112 includes at least two distinct sets of wheels: a first, inner set of rotating wheels located relatively close to or proximate to the channel 110 and the mouths of the bags being closed by the machine 100 and relatively far from or distal to the food pre-filled within the bags being closed by the machine 100, and a second, outer set of rotating wheels located relatively far from or distal to the channel 110 and the mouths of the bags being closed by the machine 100 and relatively close to or proximate to the food pre-filled within the bags being closed by the machine 100. As illustrated in FIGS. 20-23, the optical sensor 214 and the optical reflector 216 are each positioned between the inner set of rotating wheels and the outer set of rotating wheels, that is, outside with respect to the inner set of rotating wheels and inside with respect to the outer set of rotating wheels. Such positioning can improve the consistency of the detection of bags by the optical sensor 214.

As also illustrated in FIGS. 20-23, the optical sensor 214 is located below or lower than an elevation at which upper wheels in the set of rotating wheels 112 (or a timing belt coupled thereto) engage with lower wheels in the set of rotating wheels 112 (or a timing belt coupled thereto), and the reflector 216 is located above or higher than an elevation at which upper wheels in the set of rotating wheels 112 (or a timing belt coupled thereto) engage with lower wheels in the set of rotating wheels 112 (or a timing belt coupled thereto) (that is, opposite the optical sensor 214 across such an elevation). Thus, the optical sensor 214 is located below or lower than an elevation at which bags or necks thereof travel through the machine 100, and the reflector 216 is located above or higher than an elevation at which bags or necks thereof travel through the machine 100 (that is, opposite the optical sensor 214 across such an elevation such that the bags or necks thereof being closed by the machine 100 travel between the optical sensor 214 and the reflector 216). Thus, when the machine 100 is in use and applying bag closures to bags, the optical sensor 214 can detect whether a bag is located between the optical sensor 214 and the reflector 216, and can detect when a bag is not located between the optical sensor 214 and the reflector 216.

As further illustrated in FIGS. 20-23, the optical sensor 214 and the reflector 216 are aligned left-to-right or side-to-side with the locations of the wheels in the set of rotating wheels 112, and are positioned just to the right of a location where upper wheels in the set of rotating wheels 112 (or a timing belt coupled thereto) engage with lower wheels in the set of rotating wheels 112 (or a timing belt coupled thereto). As described elsewhere herein, the bags can travel right-to-left through the machine 100. Thus, the optical sensor 214 and the reflector 216 are positioned just upstream of the location where upper wheels in the set of rotating wheels 112 (or a timing belt coupled thereto) engage with lower wheels in the set of rotating wheels 112 (or a timing belt coupled thereto). When the machine 100 is in use and applying bag closures to bags, the optical sensor 214 can detect whether a bag is located between the optical sensor 214 and the reflector 216, and is therefore approaching the set of rotating wheels 112, and can detect when the bag approaching the set of rotating wheels 112 is no longer located between the optical sensor 214 and the reflector 216, and therefore is in position between the wheels in the set of rotating wheels 112 such that the bottom-most one of the bag closures in the elongate strip of connected bag closures is to be separated therefrom.

Thus, when the optical sensor 214 detects that the bag approaching the set of rotating wheels 112 is no longer located between the optical sensor 214 and the reflector 216, the optical sensor 214 can transmit a signal indicating such to the PLC 126, and the PLC 126 can relay a corresponding signal to the clutch 136. Such signal can be the signal and include the command described elsewhere herein that instructs or causes the clutch 136 to engage the driving wheel 134 to the driven shaft 138 and initiate a cycle of the mechanical bag closure breakoff assembly as described elsewhere herein. The left-to-right or side-to-side positioning of the optical sensor 214 and the reflector 216 described herein can improve the accuracy of the timing of such signals and commands indicating that a bag being closed by the machine 100 is in position between the wheels in the set of rotating wheels 112 and that the bottom-most one of the bag closures in the elongate strip of connected bag closures is to be separated therefrom.

Figure 24:
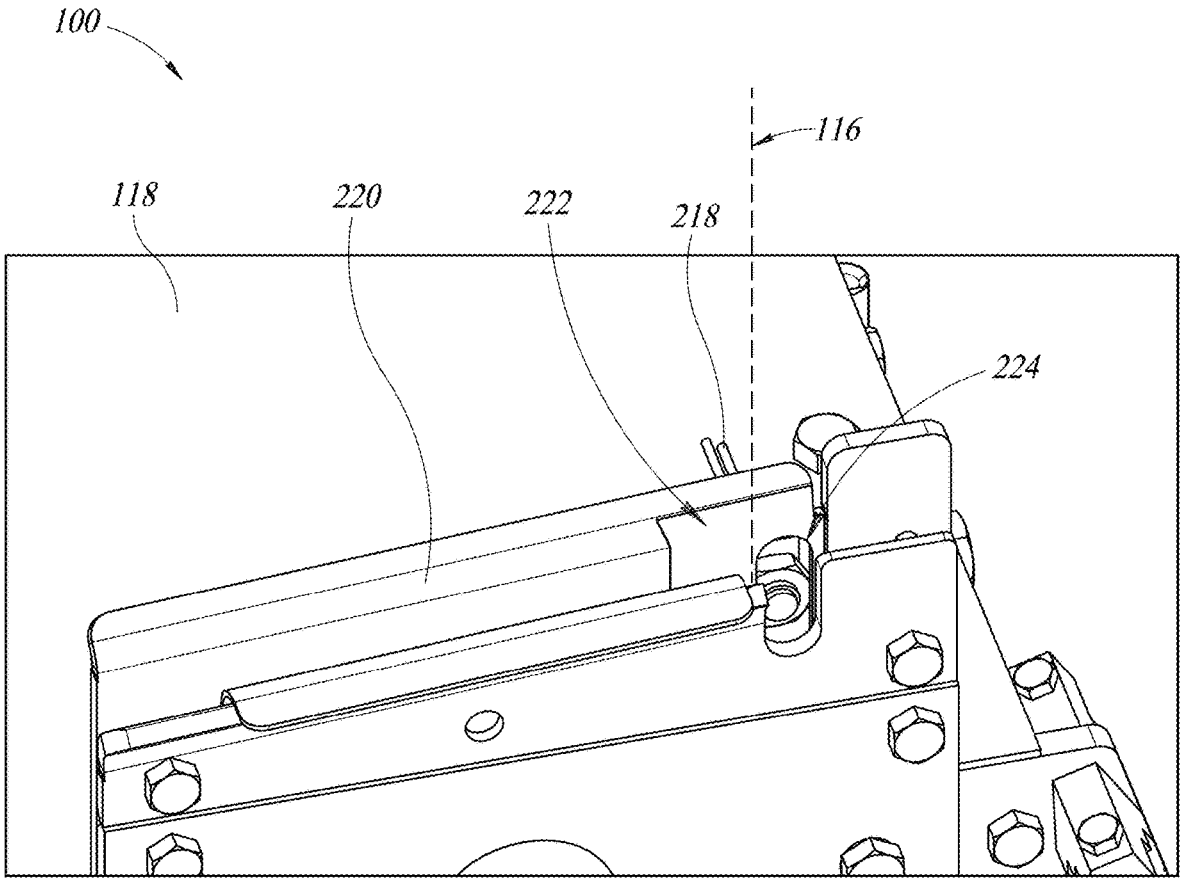
FIG. 24 illustrates a front, top, and left side perspective view of a portion of the bag closure machine of FIGS. 1 and 2 at a larger scale to show additional components for detection of a passing bag closure.
Figure 25:
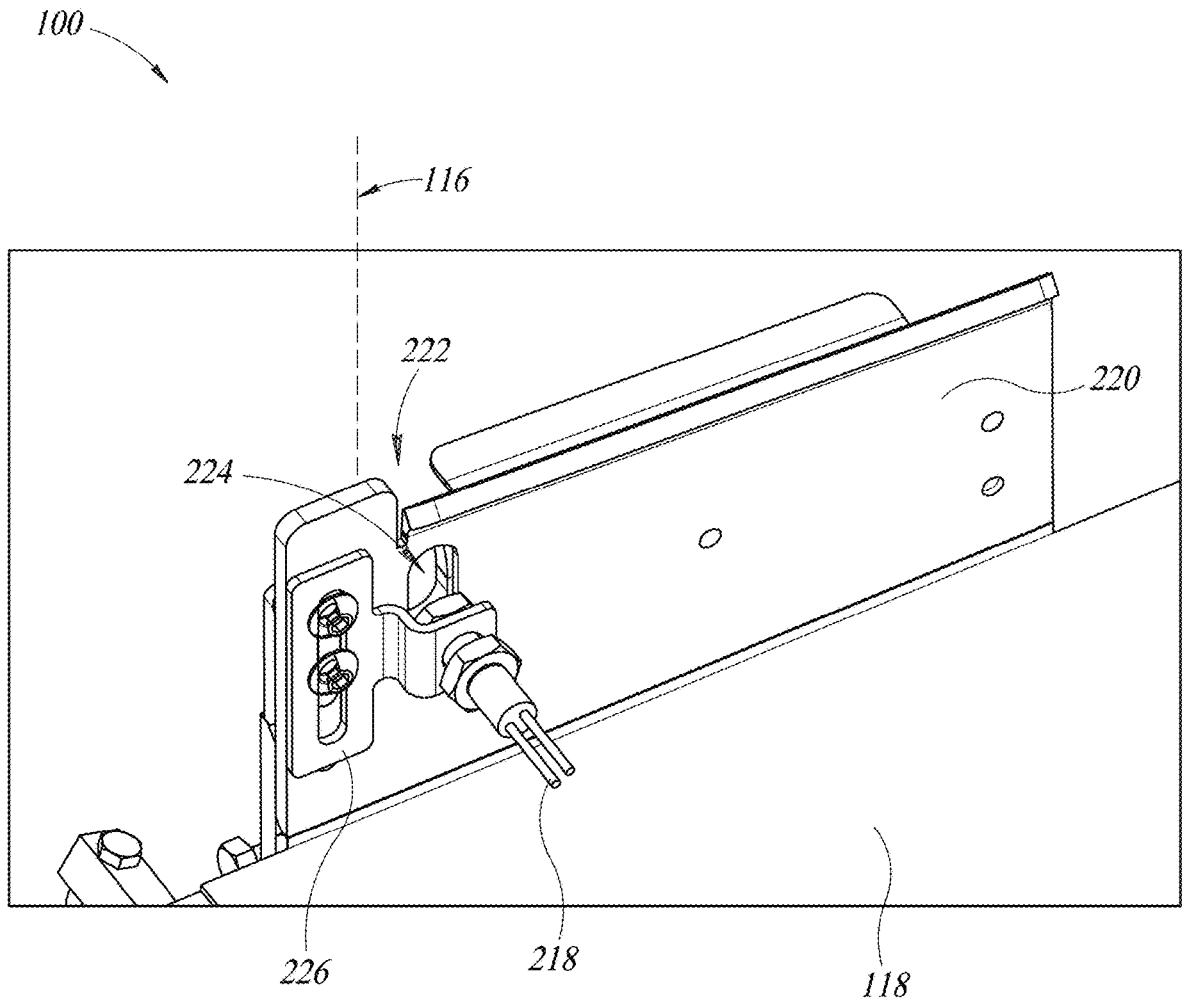
FIG. 25 illustrates a rear, top, and right side perspective view of a portion of the bag closure machine of FIGS. 1 and 2 at a larger scale to show additional components for detection of a passing bag closure.

FIGS. 24 and 25 illustrate different views of components for detection of bag closures passing through the machine 100. As illustrated in FIGS. 24 and 25, the machine 100 and the bag closure detection components include a fiber optic cable 218, which may be a commercially available fiber optic cable such as that available under the name and model number Allen Bradley 43PR-NDS57ZS, and which may extend through the device 100 to a proximal end thereof at the fiber optic amplifier and/or sensor 130 described elsewhere herein. The sensor 130 can detect and/or measure light returning to it along the cable 218, and generate a signal indicative of the detected and/or measured light, or otherwise amplify the detected or measured returning light, and communicate the same to the PLC 126.

As illustrated in FIGS. 24 and 25, the machine 100 includes a guide plate 220 that extends in a vertical and side-to-side plane. A front surface of the guide plate 220 includes a vertical groove or slot 222 along its length from a top end of the plate 220 to a bottom end of the plate 220. The slot 222 forms the open space, conduit, passage, or channel described elsewhere herein that extends up-and-down through the machine 100 along the vertical central longitudinal axis 116 thereof, and through which the elongate strip of connected bag closures travels during operation of the machine 100. Thus, the slot 222 can be referred to as an infeed track for the bag closures. As also illustrated in FIGS. 24 and 25, the guide plate 220 extends vertically above an upper surface of a top wall of the top portion of the housing 118, and includes a through-hole or opening 224 therein at a location above the upper surface of the top wall of the top portion of the housing 118 and at a right side of the slot 222.

As illustrated in FIGS. 24 and 25, the terminal distal end of the cable 218 is mounted to a top or upper portion of a rear surface of the guide plate 220 by a bracket 226, such that the terminal distal end of the cable 218 is located above the upper surface of the top wall of the top portion of the housing 118 and adjacent to and behind the opening 224, and such that the terminal distal end of the cable 218 faces forward toward and through the opening 224 and toward and through the slot 222. Thus, a terminal distal end of the cable 218 is positioned and oriented such that it is adjacent or proximate to, faces directly toward, and has a clear path to, the elongate strip of connected bag closures as they extend and move along the axis 116. Thus, together, the cable 218 and the sensor 130 can detect the presence of a bag closure or portion thereof along such path, and can also detect the absence of a bag closure or portion thereof along such path, which may indicate that the bag closures are moving along the path and that a gap between adjacent bag closures or portions thereof is presently in front of the terminal, distal end of the cable 218.

Figure 26:
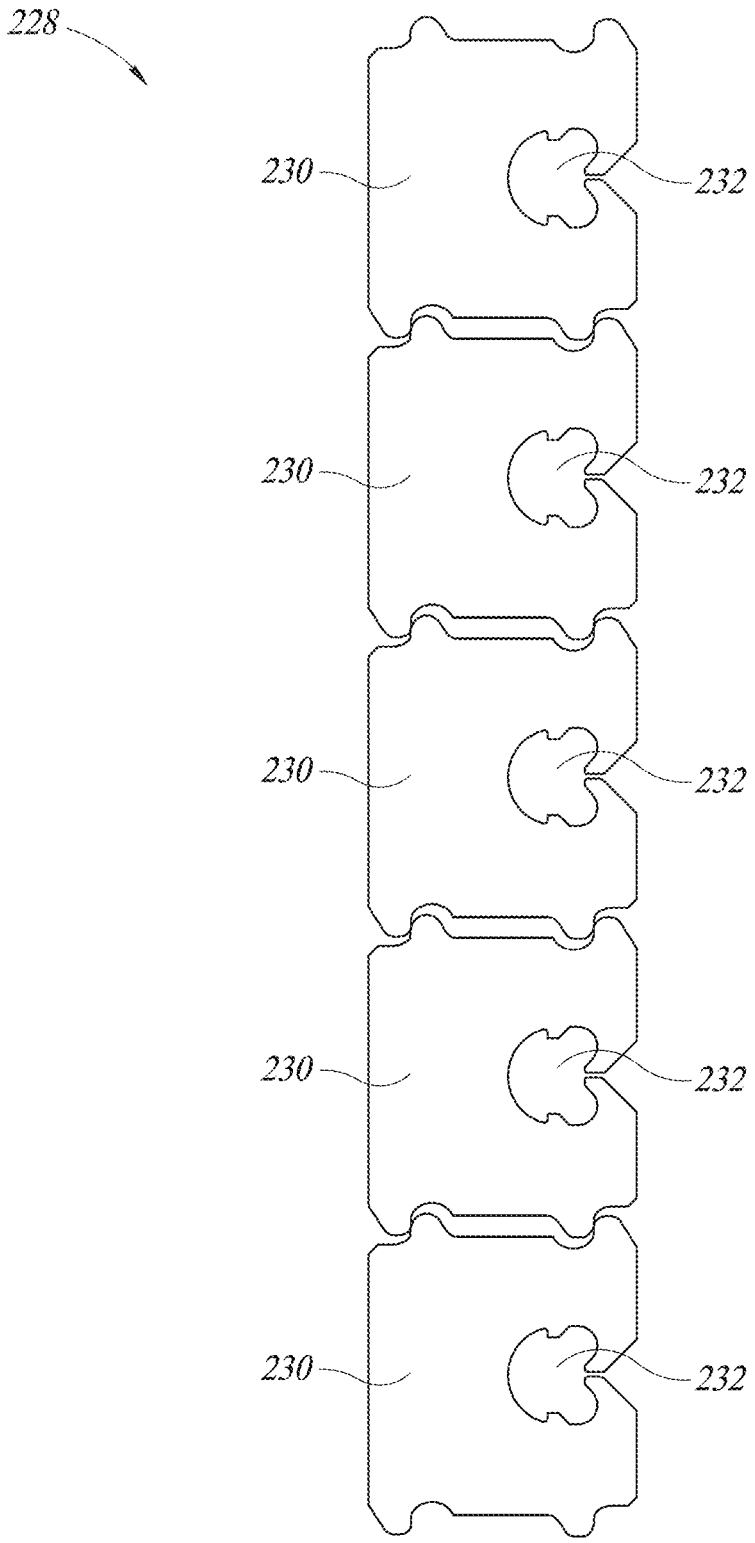
FIG. 26 illustrates an elongate strip of connected bag closures.

FIG. 26 illustrates an elongate strip of connected bag closures 228. As illustrated in FIG. 26, each of the individual bag closures 230 in the elongate strip 228 has an opening or recess 232 formed therein, which is configured to receive a bunched up portion of a neck of a bag to close the bag. As described elsewhere herein, bags travel from right-to-left through the machine 100. Thus, when the elongate strip of connected bag closures 228 is situated within the machine 100, the recesses 232 are on the right side thereof, and face toward the right, such that they are ready to receive the necks of the bags. To detect, measure, or monitor movement of the bag closures 230 through the machine 100, it is therefore advantageous to position the terminal distal end of the fiber optic cable 218 at the right side of the slot 222, such that it faces toward the right sides of the bag closures 230 as they move through the machine 100, as described elsewhere herein. Such a configuration is advantageous at least because the fiber optic cable 218 and sensor 130 can detect, measure, or monitor movement of the bag closures 230 through the machine 100 by detecting or determining whether a solid portion of a bag closure 230 or the recess 232 thereof is in front of the terminal distal end of the cable 218.

It has been found that such fiber optic detection systems, including the fiber optic cable 218 and the sensor 130, are more reliable, accurate, and precise than previous photoelectric detection systems. For example, the fiber optic systems can have greater resolution. Maximum speeds or rates at which the machine 100 can operate can be around 120 bags per minute. At such a rate, the detection system must detect the recess 232 in a bag closure 230 twice per second. Because the width of the recess 232 in a direction aligned with the axis 116 is about one third the width of the bag closure 230 in a direction aligned with the axis 116, the detection system must have a resolution of better than ⅙ of a second, or in the range of 150 milliseconds. The fiber optic detection systems described herein have been found to perform better than previous systems in this regard.

The fiber optic detection system, including the fiber optic cable 218 and the sensor 130, can be used to detect, measure, or monitor movement of the bag closures 230 through the machine 100. It can also be used to detect that the machine 100 has run out of closures, that a jam has occurred, and to trigger a printer to print text or other symbols onto the bag closures 230 as they move through the system 100. In some embodiments, if, based on the signals or measurements provided by the fiber optic detection system, it is determined that the machine 100 has run out of bag closures (e.g., if the fiber optic detection system stops detecting the presence of bag closures), then the PLC can trigger an alarm routine, and/or transmit an alarm signal, such as to the human-machine interface 106, such that the human-machine interface 106 displays an alarm signal to an operator of the machine 100 indicative that the bag closures have run out. In some embodiments, if, based on the signals or measurements provided by the fiber optic detection system, it is determined that the bag closures 230 have jammed in the machine 100 (e.g., if the fiber optic detection system detects the presence of a bag closure 230 but stops detecting movement of the bag closures), then the PLC can trigger an alarm routine, and/or transmit an alarm signal, such as to the human-machine interface 106, such that the human-machine interface 106 displays an alarm signal to an operator of the machine 100 indicative of the presence of a jam.

In some embodiments, the machine 100 is connected to a communications network, such as the internet, and any of the measurements, data, signals, etc., described herein can be transmitted to other devices over the network, and any of the components described herein can be controlled remotely by signals or instructions transmitted to the machine 100 over the network. Thus, the machine 100 can have "remote functionality," and/or can be connected to an "internet of things." In one embodiment, the machine 100 can be communicatively coupled, in either a wired or a wireless configuration, to other equipment or systems within a production and/or packaging facility, such as to a conveyor or conveyor belt or bagger therein. In such an embodiment, the communicative coupling can be used to automatically activate, turn on, or start up the machine 100 when such other equipment starts up, and/or to automatically deactivate, turn off, shut down, or put into an idle mode the machine 100 when such other equipment shuts down, stops running, or idles. Such an embodiment can be advantageous because it can reduce the chances that the machine 100 is inadvertently left running when other equipment is shut down.

The various embodiments described above can be combined to provide further embodiments. These and other changes can be made to the embodiments in light of the above-detailed description. In general, in the following claims, the terms used should not be construed to limit the claims to the specific embodiments disclosed in the specification, but should be construed to include all possible embodiments along with the full scope of equivalents to which such claims are entitled. Accordingly, the claims are not limited by the disclosure.

The invention claimed is:

1. A system, comprising:

a closure machine configured to apply bag closures to bags as the bags travel along a path with respect to the closure machine, the closure machine including:

an optical sensor located at a first side of the path; and an optical reflector located at a second side of the path opposite to the first side of the path, wherein the optical sensor and the optical reflector face one another such that light emitted by the optical sensor is reflected by the optical reflector toward the optical sensor to detect the presence of one of the bags between the optical sensor and the optical reflector as the bags travel along the path, and wherein the closure machine includes an inner set of rotating wheels and an outer set of rotating wheels that define, at least in part, the path, and the optical sensor and the optical detector are located between the inner set of rotating wheels and the outer set of rotating wheels.

2. The system of claim 1, wherein the optical sensor or the optical reflector, or both, are located above or below wheels of the closure machine that define, at least in part, the path.

3. The system of claim 1, wherein the optical sensor is below the path and the optical reflector is above the path.

4. The system of claim 1, wherein the closure machine further includes a fiber optic cable facing toward the bag closures.

5. The system of claim 4, wherein the closure machine includes a guide plate having a slot and an opening, the bag closures configured to be received in the slot and the fiber optic cable faces the opening in the guide plate.

6. The system of claim 1, wherein the second side of the path is located opposite to the first side of the path in a vertical direction.

* * * * *